US006202747B1

(12) United States Patent
Lacy et al.

(10) Patent No.: US 6,202,747 B1
(45) Date of Patent: Mar. 20, 2001

(54) HYDRAULIC WELL PACKER AND METHOD

(75) Inventors: Rodger Dale Lacy; Billy Ray Newman, both of Houston, TX (US); John Hughes, S.W. Calgary (CA)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/387,015

(22) Filed: Aug. 31, 1999

Related U.S. Application Data

(60) Provisional application No. 60/098,851, filed on Sep. 2, 1998.

(51) Int. Cl.[7] ..... E21B 33/1295

(52) U.S. Cl. ..... 166/120; 166/322; 166/323

(58) Field of Search ..... 166/119, 120, 166/123, 319, 322, 323, 338, 339, 373–375, 381–383, 386, 387

(56) References Cited

U.S. PATENT DOCUMENTS

| | | | | |
|---|---|---|---|---|
| 3,456,723 | | 7/1969 | Current et al. . | |
| 3,570,596 | | 3/1971 | Young . | |
| 3,603,388 | | 9/1971 | Current et al. . | |
| 3,722,588 | * | 3/1973 | Tamplen . | |
| 3,851,705 | * | 12/1974 | Jett et al. | 166/120 |
| 3,858,648 | * | 1/1975 | Jett | 166/120 |
| 3,915,261 | * | 10/1975 | Jett et al. . | |
| 3,921,720 | | 11/1975 | Wetzel . | |
| 4,141,413 | | 2/1979 | Morris et al. . | |
| 4,263,968 | | 4/1981 | Garner, Jr. . | |
| 4,518,037 | | 5/1985 | Youngblood et al. . | |
| 4,671,354 | | 6/1987 | Henderson et al. . | |
| 4,708,208 | | 11/1987 | Halbardier . | |
| 4,750,564 | | 6/1988 | Pettigrew et al. . | |
| 4,791,992 | | 12/1988 | Greenlee et al. . | |
| 4,823,882 | | 4/1989 | Stokley et al. . | |
| 4,834,175 | | 5/1989 | Ross et al. . | |
| 4,917,187 | | 4/1990 | Burns et al. . | |
| 4,928,762 | | 5/1990 | Mamke . | |
| 5,000,265 | | 3/1991 | Pleasants et al. | 166/387 |
| 5,048,613 | | 9/1991 | Shilling . | |
| 5,094,294 | | 3/1992 | Bayh, III . | |
| 5,129,454 | | 7/1992 | Telfer . | |
| 5,217,077 | | 6/1993 | Hart . | |
| 5,343,956 | | 9/1994 | Coronado . | |
| 5,522,464 | | 6/1996 | Piper . | |

FOREIGN PATENT DOCUMENTS

WO 00/12862 3/2000 (WO) .

* cited by examiner

*Primary Examiner*—Roger Schoeppel
(74) *Attorney, Agent, or Firm*—Goldstein & Healey LLP

(57) ABSTRACT

A hydraulically controlled packer for an oil or gas well is disclosed that is capable of being hydraulically unset. One embodiment of the invention is capable of being hydraulically unset prior to locking thus allowing fine tuning of packer location in relation to oil-bearing strata. Other embodiments of the invention are capable of being hydraulically unlocked and unset for further use within the oil or gas well without being withdrawn to the surface for reassembly. The invention may be used in downhole well tools other than packers.

31 Claims, 30 Drawing Sheets

HYDRAULIC WELL PACKER AND METHOD

RELATED APPLICATIONS

This application claims the benefit of U.S. Provisional Application No. 60/098,851, filed Sep. 2, 1998.

BACKGROUND OF THE INVENTION

1. Field of the Invention

The present invention relates generally to oil and gas well completion and production. In particular, the present invention relates to hydraulically controlled packer structures and associated methods utilized in well completion and production activities.

2. Description of the Prior Art

It is well known in the art to provide a well packer between the outer casing and the production tubing of an oil or gas well to isolate and seal off production fluids. It is also well known to set such packers hydraulically. Examples of hydraulically set packers can be found in U.S. Pat. Nos. 3,456,723, 3,603,388 and 4,263,968. In the hydraulic packers of the prior art, the setting of the packer would lock the packer in place within the outer casing of the well. To release the prior art packer required mechanical axial or rotational motion so that screws or other retaining means would shear and allow the packer to relax and be withdrawn from the well. In order to reuse the packer of the prior art, it was necessary to remove the packer completely from the well for reassembly with new shear screws or similar retaining means. Also, once set and locked, the packer could not be repositioned within the well bore. This made fine tuning of the packer's location relative to oil-bearing strata difficult.

The mechanical method for releasing prior art packers is particularly disadvantageous in wells containing multiple stacked packers. In these wells, the force required to shear the packers free requires the use of slip joints between packers set in close proximity to assure release of the packers individually. In addition, the modern trend toward intelligent completion components requires hydraulic and electrical conduits through packers. These conduits are easily damaged when mechanical releasing means are used.

Accordingly, there exists a need for a hydraulic packer that can be set, unset and reset prior to locking so that the packer location in relation to oil-bearing strata can be fine tuned and well completion components can be functionally checked. There is also a need for a hydraulic well packer that can be unset and reset without rendering the setting and locking mechanism inoperable so that the well packer can be easily relocated within the well casing without the need to retrieve and reassemble the well packer. Additionally, there is a need for a hydraulic well packer that can be released through application of hydraulic pressure rather than through mechanical axial or rotational motion to allow packer stacking and to protect hydraulic and electrical conduits. These needs are met by the present invention.

SUMMARY OF THE INVENTION

The present invention is directed to various embodiments of a hydraulic well packer. Like prior art hydraulic packers, the hydraulic packer of the present invention uses hydraulic pressure to set and lock within a well casing. In addition, one embodiment of the present invention is capable of unsetting and resetting prior to locking to allow fine tuning of the packer's position within a well. In other embodiments, the hydraulic packer of the present invention is capable of hydraulically unlocking and unsetting so that the packer can be reused in another location within a well without the need for withdrawal from the well for reassembly. The hydraulic unset and release features of the various embodiments also offer advantages in cases where multiple packers are closely stacked or where hydraulic and electrical conduits extending through the packer could be damaged by mechanical motion. The various embodiments of the present invention are summarily described below.

A first embodiment of the present invention is capable of being hydraulically set, unset and reset prior to locking. This embodiment uses three discrete sources of hydraulic pressure, a setting port, an unsetting port, and a locking port. The object of this embodiment is the ability to set and unset the packer multiple times without locking the packer in place. This embodiment features at least one double acting setting piston and at least one locking piston with a ratcheted surface. The setting piston operates slips and sealing elements in the conventional manner. Hydraulic pressure from the setting port actuates the double acting setting piston such that the slips and sealing elements engage the well casing wall. Conversely, hydraulic pressure from the unsetting port actuates the double acting setting piston in the opposite direction allowing the slips and sealing elements to return to their running positions. In this manner, the packer can be repositioned multiple times. When the packer is in the desired position and hydraulically set, hydraulic pressure from the locking port actuates the locking piston. The locking piston abuts the setting piston and the ratcheted surface of the locking piston engages matching ratchets on the mandrel thus locking the slips and sealing elements in place. Once locked in place, this packer can be removed in the conventional manner by axial movement that shears screws thus requiring removal and reassembly prior to further use. Alternatively, hydraulic pressure applied to a release port can shear screws to release the packer.

A second embodiment of the present invention is capable of being hydraulically set and locked as well as hydraulically unlocked and unset. This embodiment uses two distinct sources of hydraulic pressure, a setting port that sets and locks the packer and an unsetting port that unlocks and unsets the packer. A feature of this embodiment is the ability to set/lock and unlock/unset multiple times without being removed from the well. This embodiment uses at least one double acting piston with a cavity having a small section and a large section. The fingers of a collet are disposed within the cavity. The cavity is shaped such that when the fingers are within the small section they are held tightly against the mandrel. Conversely, when the fingers are within the large section the fingers can be readily lifted away from the mandrel. The interior surface of the fingers has ratchets that are designed to engage matching mandrel ratchets and lock the collet in place. The opposite end of the collet is fixed to actuating means that actuate the slips and seal elements in a conventional manner. Application of hydraulic pressure from the setting port forces the double acting piston to carry the fingers over the mandrel ratchets thus setting and locking the packer. Application of hydraulic pressure from the unsetting port forces the double acting piston in the opposite direction thus lifting the fingers away from the mandrel and unsetting the packer to a running configuration.

A third embodiment of the present invention is also capable of being hydraulically set and locked as well as hydraulically unlocked and unset. This embodiment uses two distinct sources of hydraulic pressure, a setting port that sets and locks the packer and an unsetting port that unlocks and unsets the packer. The hydraulic packer of this embodiment is capable of being set/locked and unlocked/unset multiple times without being removed from the well. This embodiment features at least one double acting piston disposed to move axially and capable of actuating slips and seal elements in a conventional manner. At least one locking piston is disposed within the double acting piston and oriented to actuate in a direction perpendicular to the longitudinal axis of the mandrel. The surface of the spring loaded locking piston adjacent to the mandrel is ratcheted and designed to engage matching ratchets on the mandrel. The locking piston is spring loaded so that it naturally presses against the mandrel. Within the locking piston is at least one plunger valve that is normally closed to a bleed port within the locking piston. The packer is set and locked by applying hydraulic pressure to a setting chamber that forces the double acting piston to slide axially and engage the slips and sealing elements. As the double acting piston slides, the locking piston is carried with it and engages the mandrel ratchets thus locking the slips and sealing elements. To unlock and unset the packer, hydraulic pressure from the unsetting port forces the locking piston away from the surface of the mandrel. The plunger valve is sized to open when the locking piston ratchets are clear of the mandrel ratchets. Upon opening, the plunger valve allows pressurized hydraulic fluid from the unsetting port into an unsetting chamber that forces the double acting piston back to its running position and unsets the packer.

A fourth embodiment of the present invention is capable of being hydraulically set and locked as well as unlocked and unset. This embodiment uses two distinct sources of hydraulic pressure, a setting port that sets and locks the packer and an unlocking port that unlocks the packer so that it can unset. The hydraulic packer of this embodiment is capable of being set/locked and unlocked/unset multiple times without being removed from the well. This embodiment features at least one setting piston disposed to move axially and capable of actuating slips and seal elements in a conventional manner. Ratchets on the setting piston engage matching ratchets on the interior of a rotating lock ring. The ratchets on the setting piston and the rotating lock ring have axial grooves that allow the ratchets to disengage when the rotating lock ring is rotated in relation to the setting piston. Likewise, the ratchets reengage upon further rotation of the rotating lock ring. At least one unlocking piston in communication with the unlocking port transmits axial motion to at least one annular housing capable of axial and rotational motion. The annular housing includes a tab that slides within a helical groove in the packer housing. The annular housing is slidably connected to the rotating lock ring so that rotational motion is transmitted to the rotating lock ring. Axial motion of the unlocking piston is converted into rotational motion of the rotating lock ring through the interaction of the annular housing and the helical groove. To set and lock the packer, hydraulic fluid from the setting port pressurizes a setting chamber and causes the setting piston to axially translate and engage the slips and seal elements. The ratchets on the setting piston and rotating lock ring engage and lock the packer in place within the well casing. To unlock and unset the packer, hydraulic pressure is introduced into the unlocking chamber which causes the rotating lock ring to rotate and disengage the ratchets. After the setting piston is unset, hydraulic pressure on the unlocking port is released allowing the rotating lock ring to rotate to its original position thus reengaging the ratchets.

Other objects, advantages and novel features of the present invention will become apparent from the following detailed description of the invention, when considered in conjunction with the accompanying drawings.

DESCRIPTION OF THE PREFERRED EMBODIMENTS

Figure 1A:
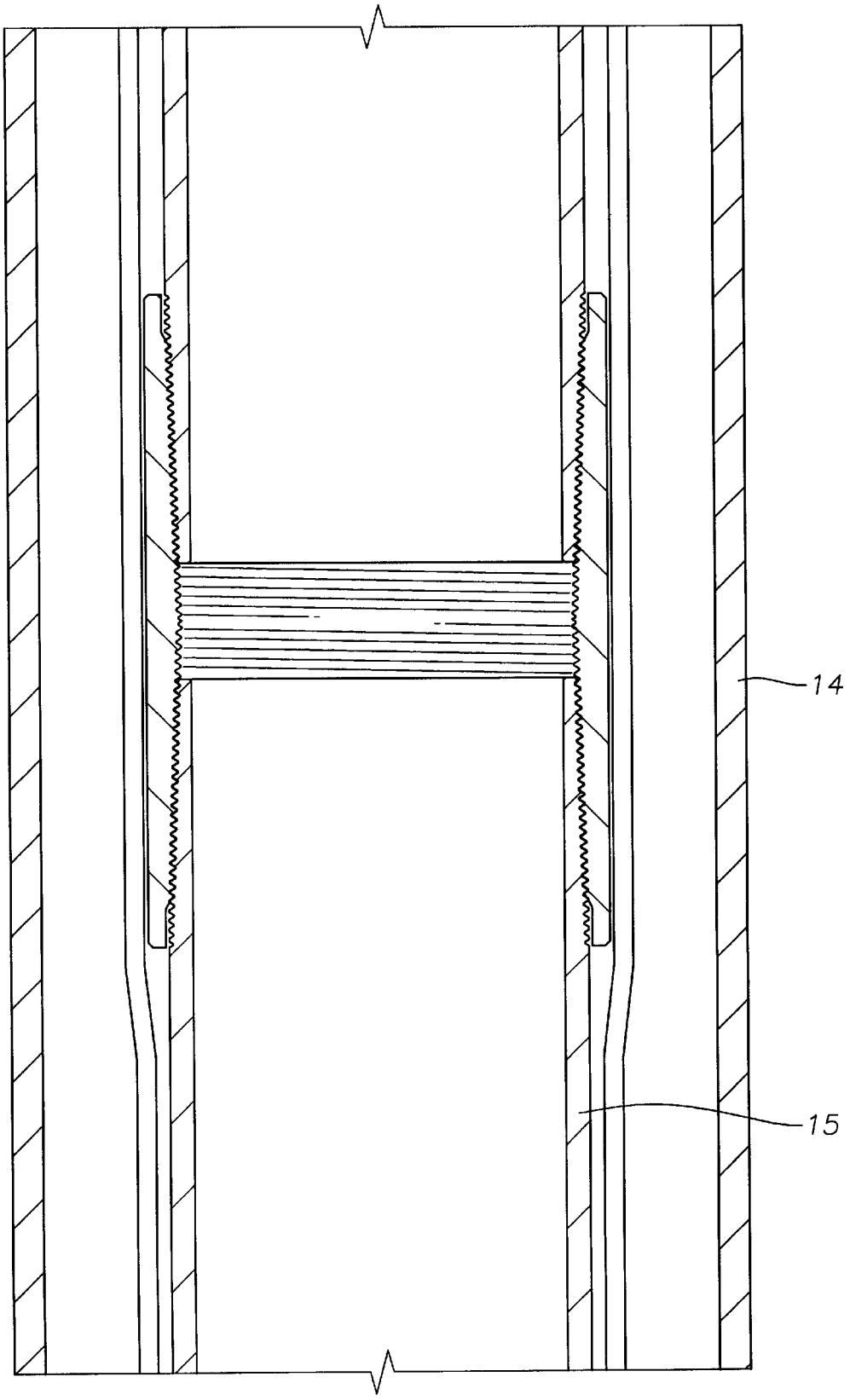
FIGS. 1A through 1G are continuations of each other and form an elevational view in cross-section showing the hydraulic packer of the first embodiment of the invention in running configuration.
Figure 1B:
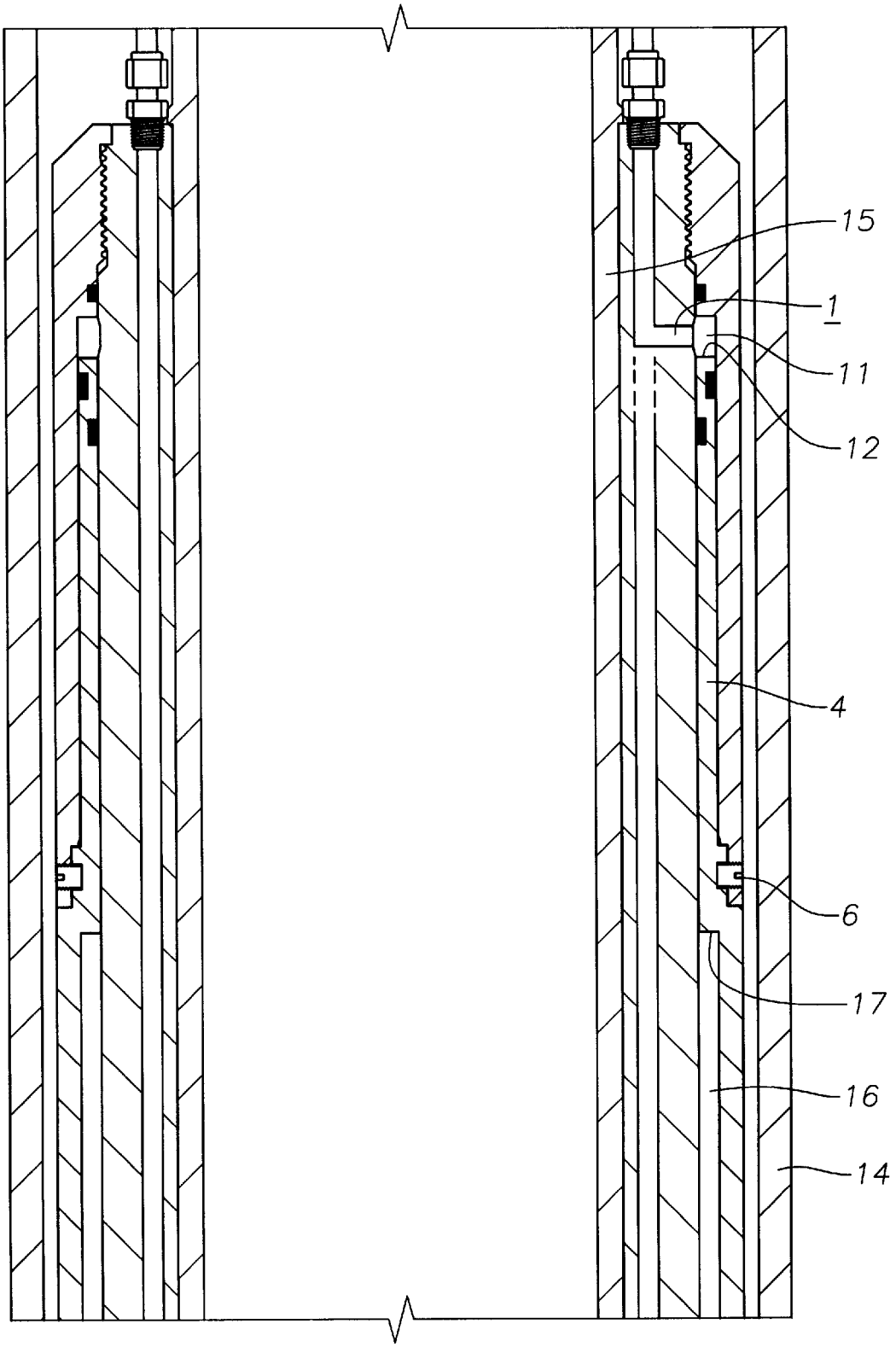
Figure 1C:
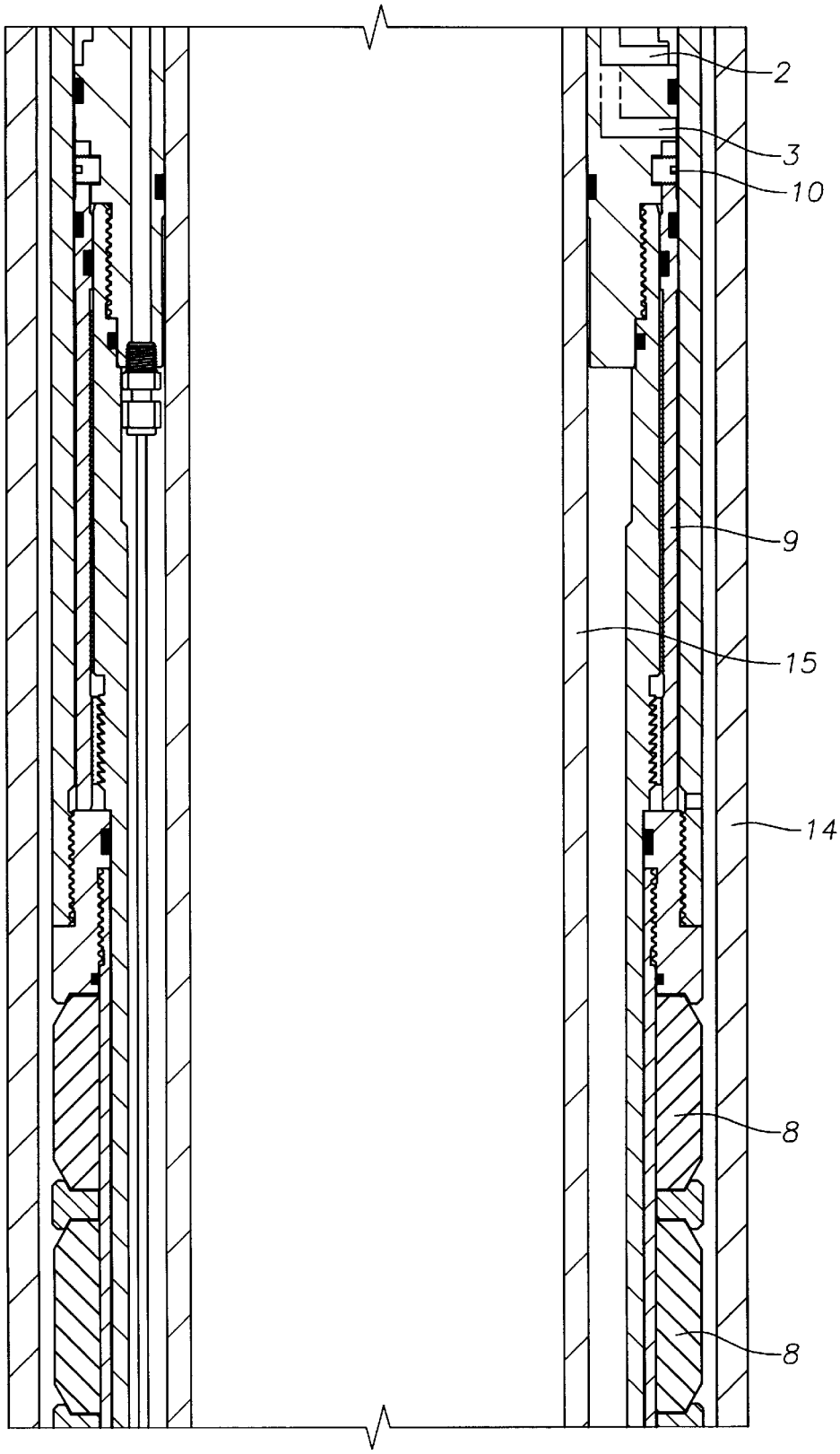
Figure 1D:
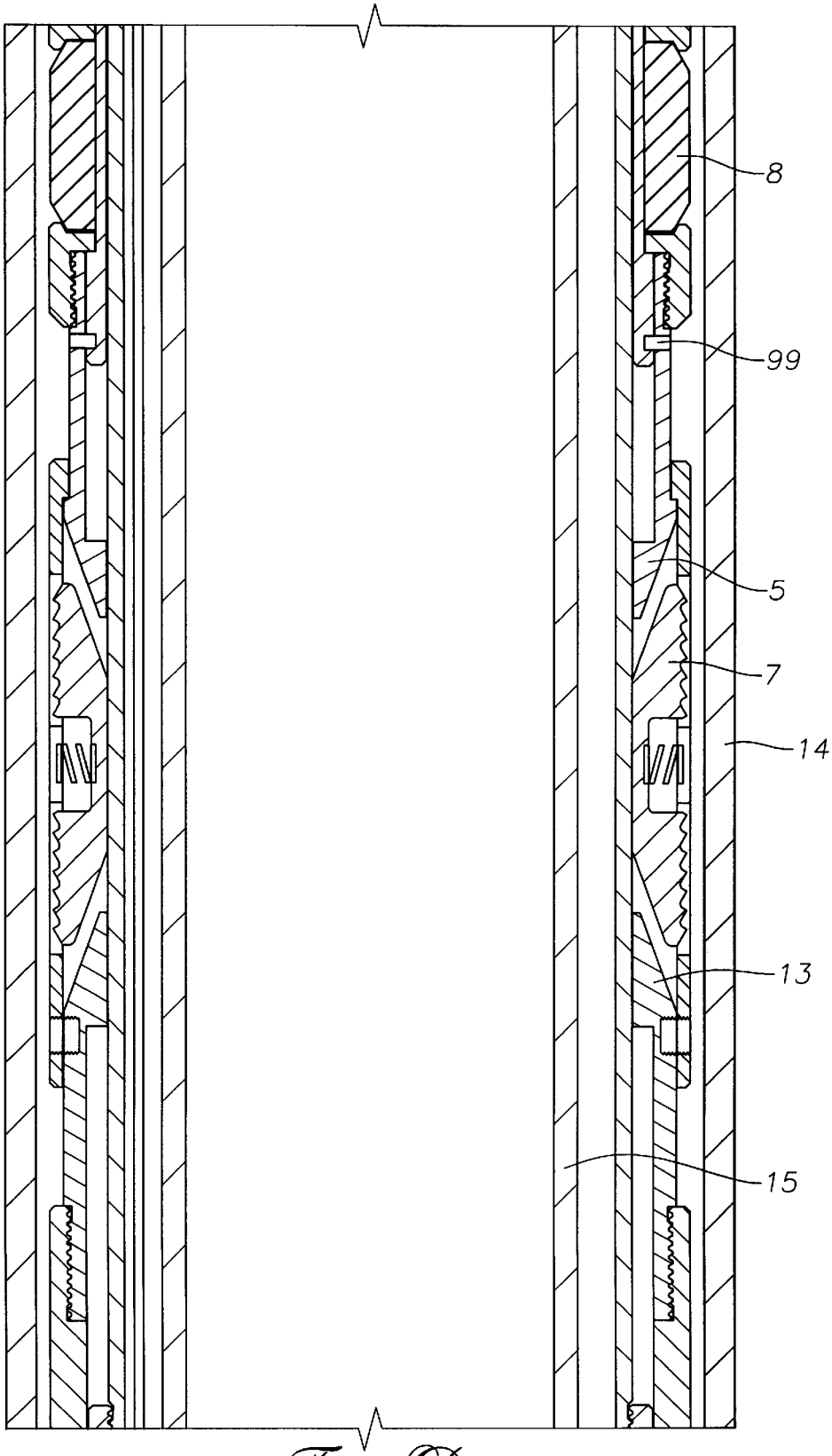

In a broad aspect, this invention comprises a downhole well apparatus that includes a support mandrel (23, 36, 59, 150) disposable inside of a well casing (14, 47, 152, 154), a plurality of slips (7, 45, 56, 71), at least one seal element (8, 46, 57, 72), at least one setting piston (4, 29, 55, 70), a source of setting hydraulic pressure (not shown apart from its associated port 1, 28, 53, 68), and a source of unsetting hydraulic pressure (not shown apart from its associated port 2, 27, 54, 69). The setting piston is movably disposed within the mandrel. The slips, which are supported on the mandrel, are movable relative to the mandrel between an inwardly retracted running position and an outwardly extending set position. The movement of the slips is generated by the movement of the setting piston, which also causes the seal elements to compress into sealing relationship between the support mandrel and the well casing. The movement of the setting piston, in turn, is caused by the sources of setting and unsetting hydraulic pressure. In response to setting hydraulic pressure, the setting piston sets the slips and seal elements. In response to unsetting hydraulic pressure, the setting piston unsets the slips and seal elements.

In one embodiment, the invention further comprises a locking piston (9) and a source of locking hydraulic pressure (not shown apart from its associated port 3). In response to locking hydraulic pressure, the locking piston moves against and locks the setting piston in place. The locking piston preferably includes ratchets (20, 48, 60, 78) that engage matching ratchets (21) associated with the mandrel to unidirectionally lock the locking piston in place as it moves.

In another embodiment, the movement of the setting piston is still caused by the sources of setting and unsetting hydraulic pressure. However, in this embodiment, in response to setting hydraulic pressure, the setting piston not only sets but also locks the slips and seal elements. And, in response to unsetting hydraulic pressure, the unsetting piston not only unsets but also unlocks the slips and seal elements.

This invention may be practiced with a variety of embodiments. Four embodiments of the invention, each including some additional elements and structure, will now be presented and discussed.

1. Embodiment #1

A first embodiment of the hydraulic packer of the present invention is capable of being hydraulically set, unset and reset prior to locking. Referring now to FIGS. 1A through 1G, the embodiment uses three discrete sources of hydraulic pressure, a setting port 1, an unsetting port 2, and a locking port 3. These ports are in communication with sources of hydraulic pressure (not shown), which may consist of hydraulic lines extending to the surface, hydraulic accumulators, or other similar devices well known to those skilled in the art. The hydraulic packer includes at least one double acting setting piston 4 which is attached to and operates at least one upper slip wedge 5 to compress slips 7 and sealing elements 8 in a conventional manner. The hydraulic packer further includes at least one locking piston 9. While running the hydraulic packer downhole, the double acting setting piston 4 is held in place by screws 6 and 99 and the locking piston is held in place by screw 10.

Referring now to FIGS. 1A through 1F and 2A through 2D, upon application of hydraulic pressure to the setting port 1, the setting cavity 11 is pressurized and applies force to a surface 12 of the double acting setting piston 4. Upon application of sufficient hydraulic pressure, screws 6 and 99 shear and allow the double acting setting piston 4 to move in the setting direction. As the double acting setting piston 4 moves in the setting direction, the upper slip wedge 5 forces slip 7 into contact with lower slip wedge 13. As the double acting setting piston 4 continues to move in the setting direction, slips 7 are forced outward and into engagement with the well casing wall 14. Continued movement of the double acting setting piston 4 in the setting direction compresses sealing elements 8 thus effecting a seal between the well casing wall 14 and the production tubing 15. A wide variety of slip and sealing element configurations are old and well known in the art. As will be appreciated by those skilled in the art, the present embodiment could be modified to function with a variety of other slip and sealing element configurations. It is to be understood that the embodiment described herein includes other slip and sealing element mechanisms that would be known to a skilled artisan.

To unset the double acting setting piston prior to locking so that the position of the packer can be fine tuned, hydraulic pressure is applied to the unsetting port 2 which pressurizes the unsetting chamber 16 applying force to a surface 17 of double acting setting piston 4. This force unsets double acting setting piston 4 to its original position and allows the sealing elements 8 and slips 7 to retract to their running positions so that the packer can be moved.

Referring now to FIGS. 1A through 1F and 3, once a desirable packer position is attained and the packer is set as described above, hydraulic pressure is applied to the locking port 3 which pressurizes the locking chamber 18 applying force to a surface 19 of locking piston 9. Upon application of sufficient force, screw 10 shears and allows locking piston 9 to move in a locking direction. As locking piston 9 moves in a locking direction, locking piston ratchets 20 engage matching mandrel ratchets 21. In the preferred embodiment, the mandrel ratchets 21 are machined into an annular ring 22 that is axially fixed about the mandrel 23. This assembly has disassembly and maintenance advantages. However, a skilled artisan will recognize that the mandrel ratchets 21 could also be machined directly into the mandrel 23. As locking piston 9 continues to move in a locking direction, it abuts double acting setting piston 4 thus locking the packer assembly in place.

Figure 1E:
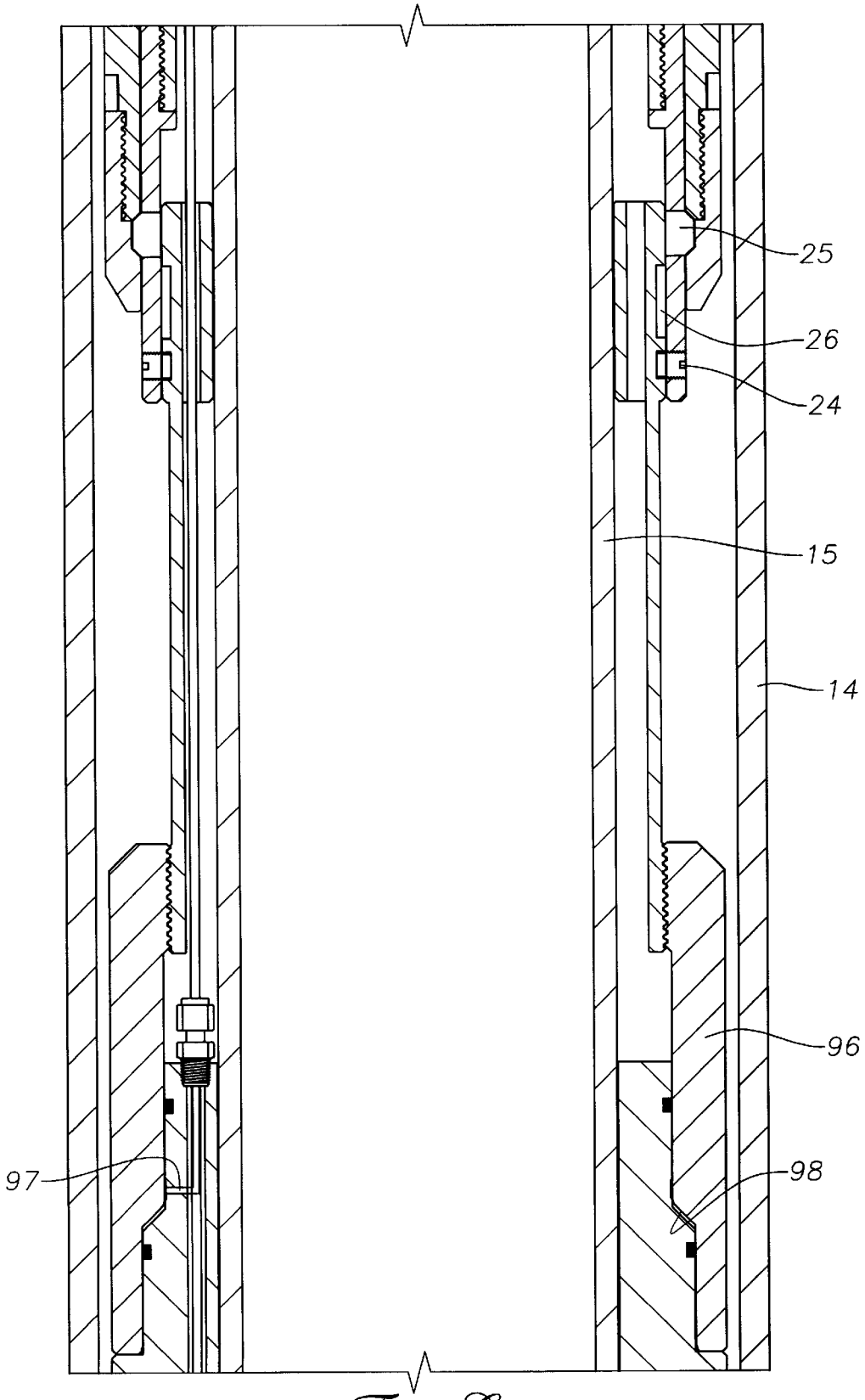
Figure 1F:
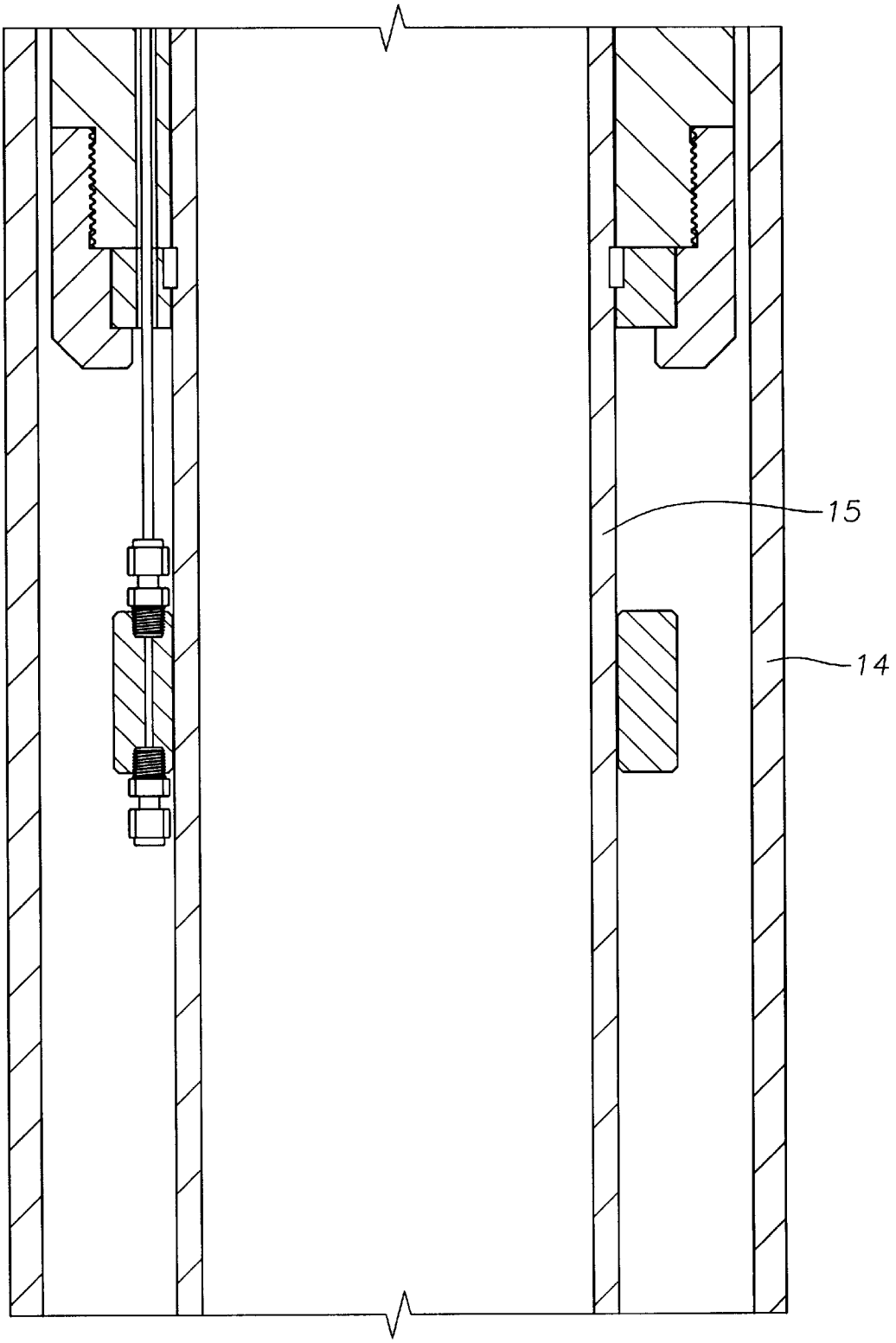
Figure 1G:
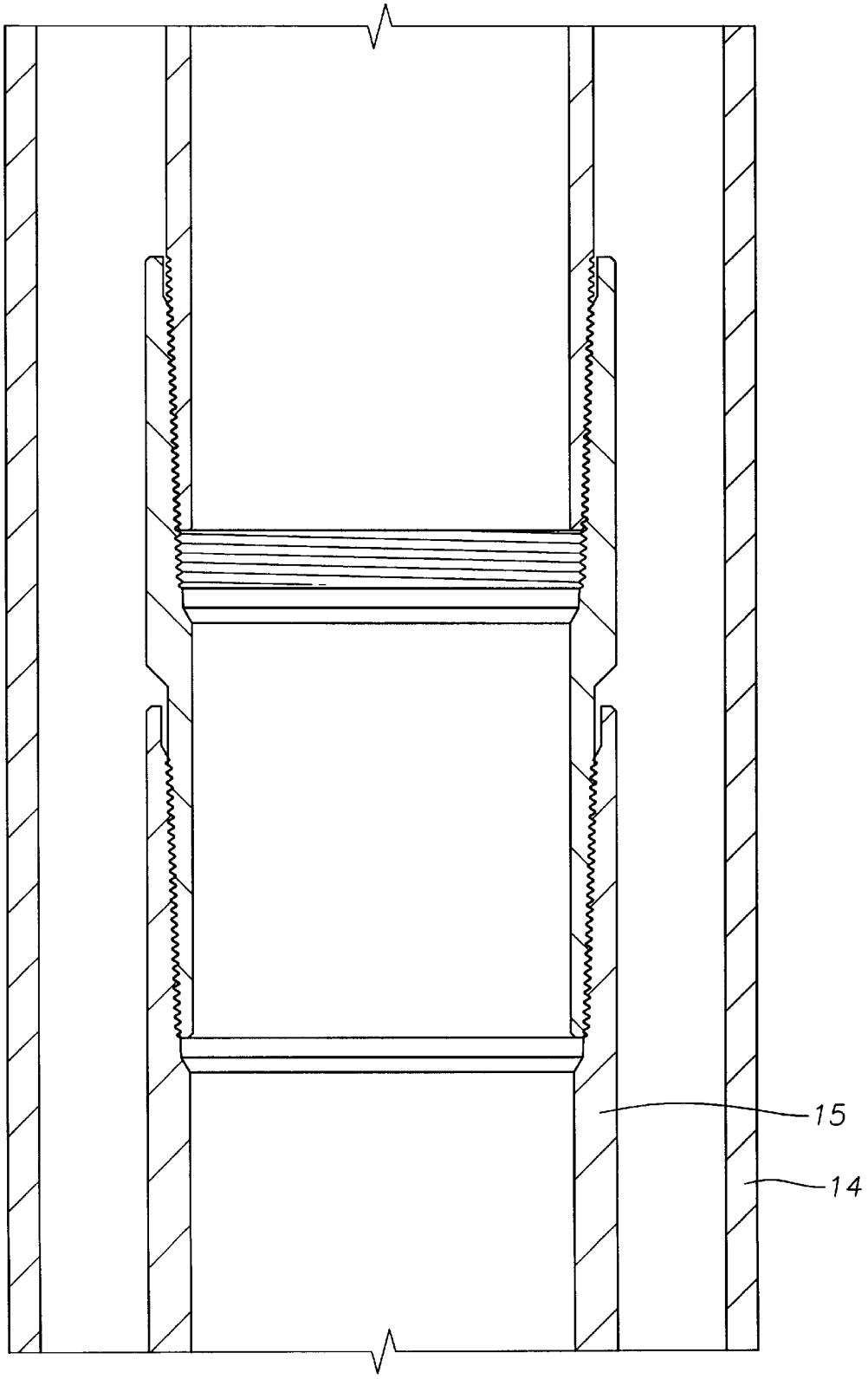
Figure 2A:
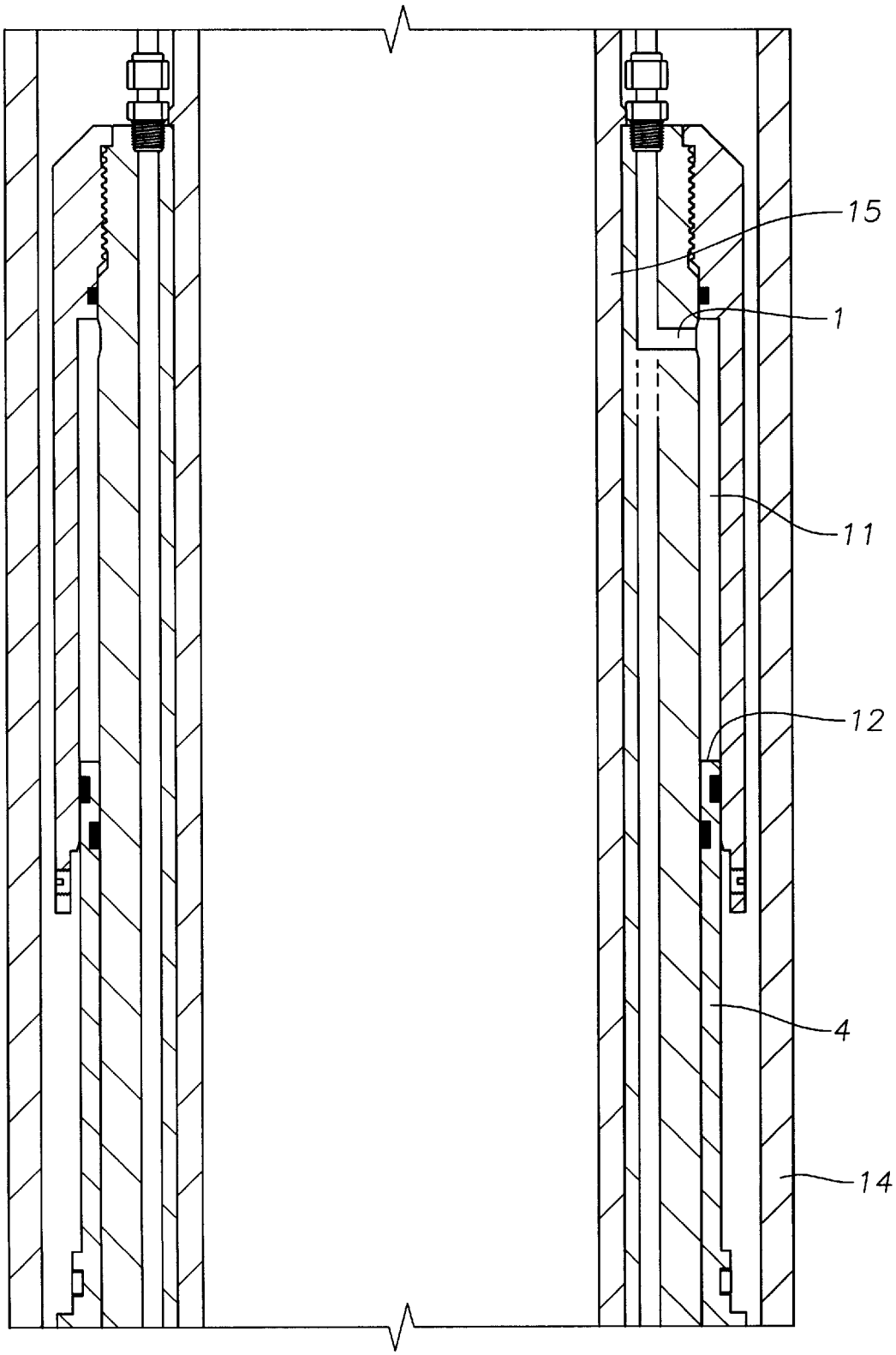
FIGS. 2A through 2C are continuations of each other and form an elevational view in cross-section showing a portion of the hydraulic packer of the first embodiment of the invention in set configuration prior to locking.
Figure 2B:
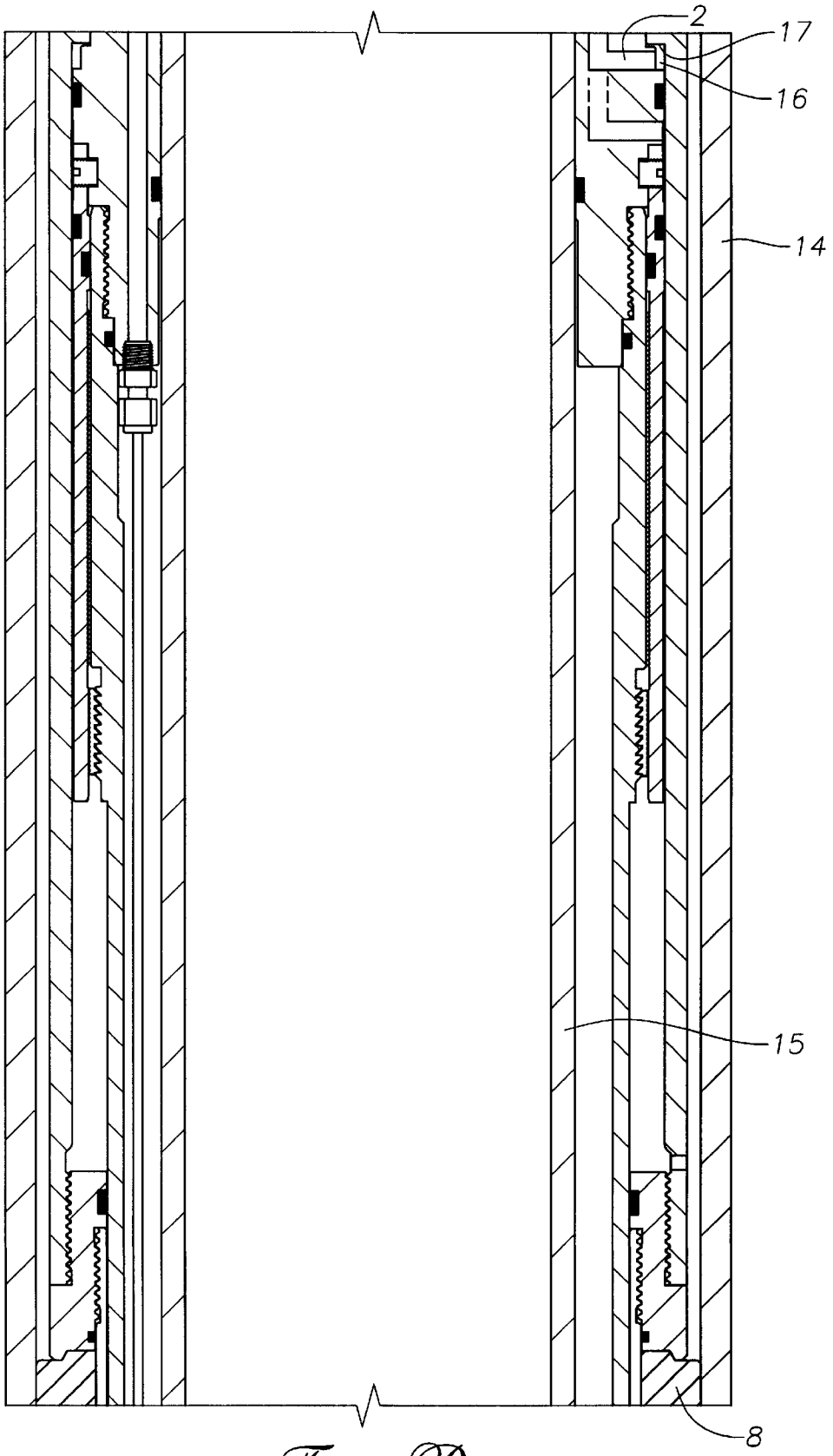
Figure 2C:
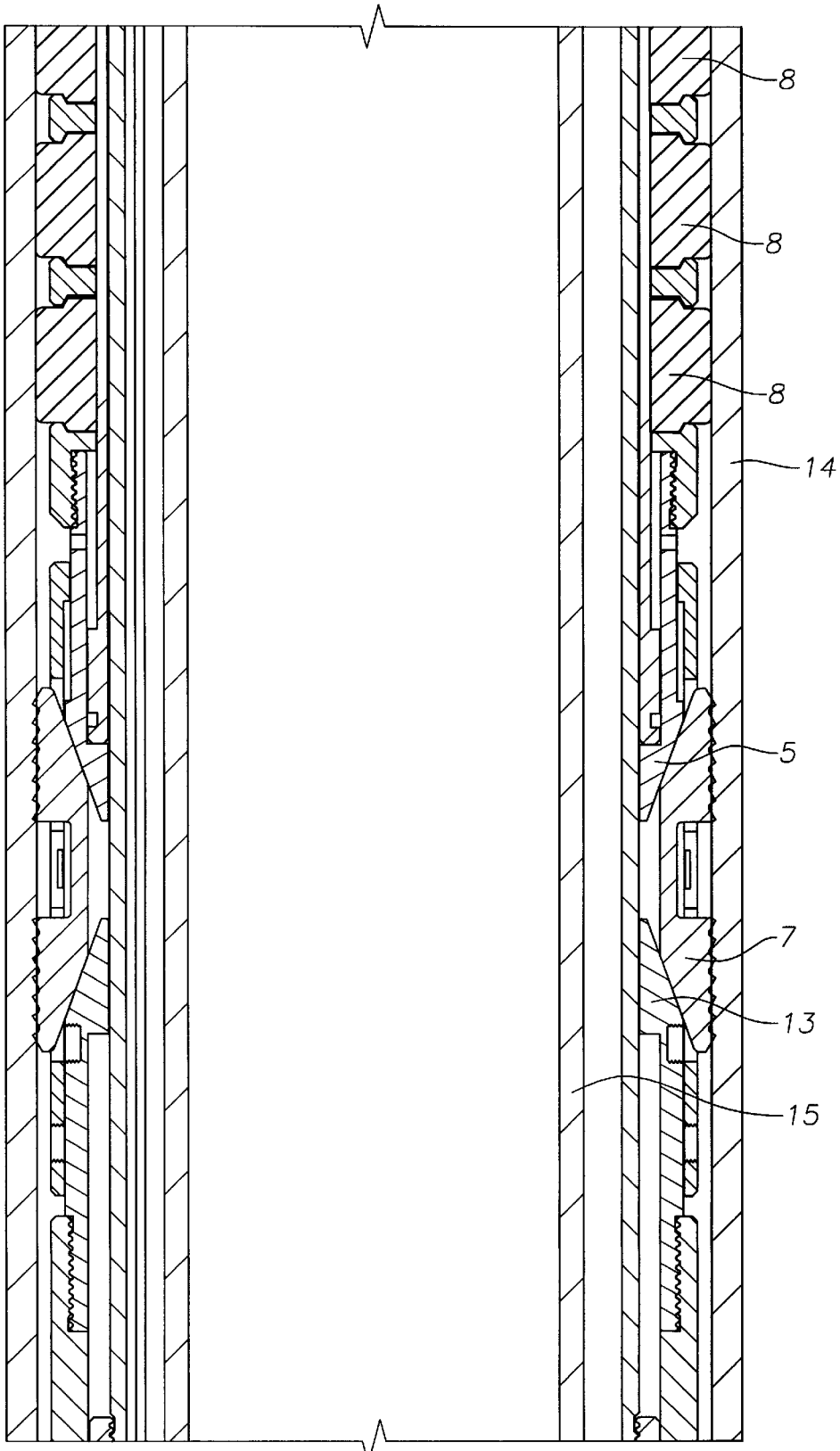
Figure 3:
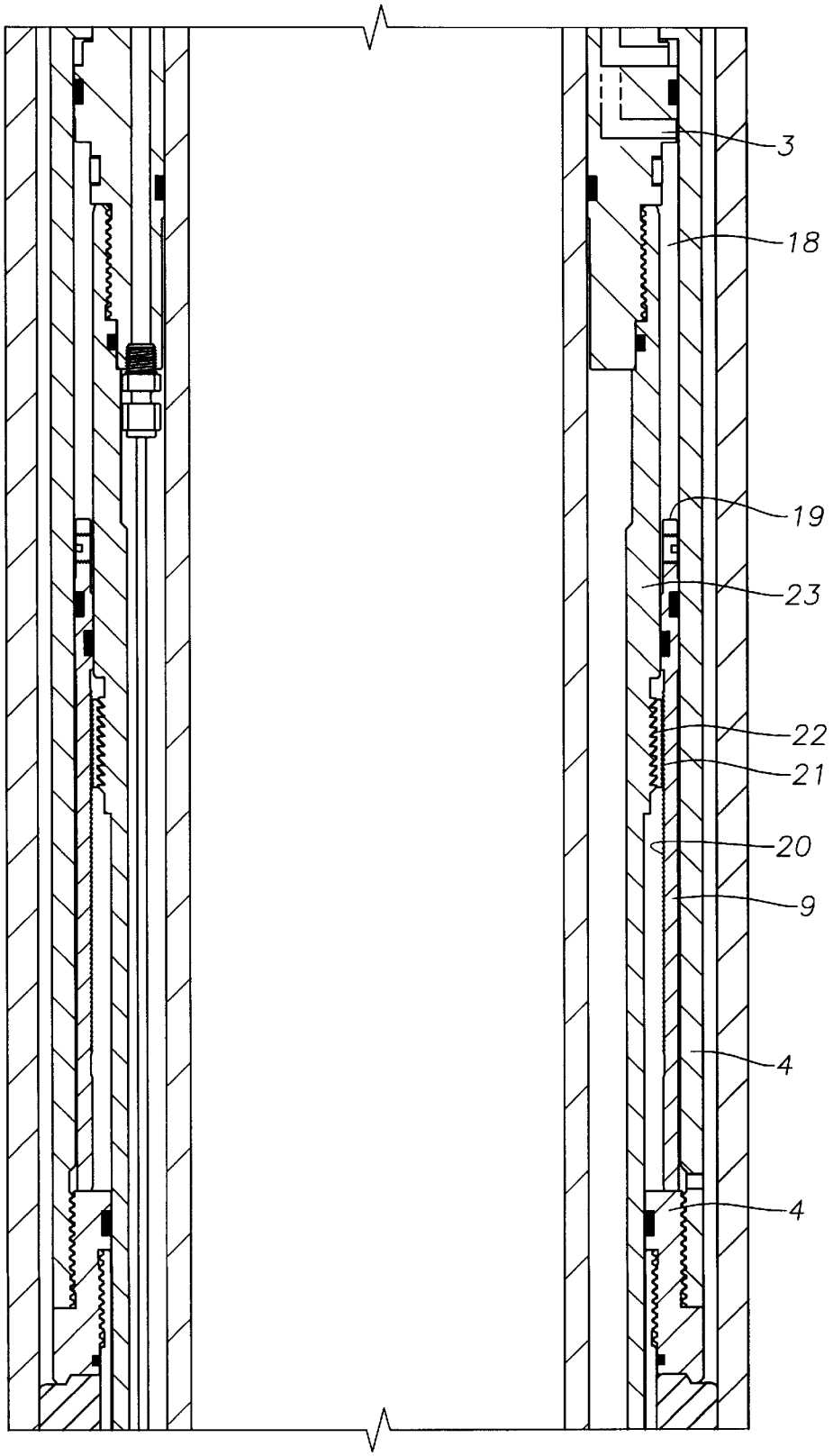
FIG. 3 is an elevational view in cross-section showing a portion of the hydraulic packer of the first embodiment of the invention in locked configuration.

Referring now to FIG. 1E, this embodiment of the packer is released through the application of axial force to production tubing 15 which shears screw 24 allowing locking dog 25 to slide into groove 26 thus releasing the assembly. This method of releasing is old and well understood in the art. It requires that the packer be removed from the well for reassembly prior to further use. In a further embodiment of the present invention, hydraulic pressure may be applied to a distinct release port 97 pressurizing chamber 98 and causing release piston 96 to shear screw 24 allowing locking dog 25 to slide into groove 26 thus releasing the assembly. The hydraulic release feature described herein is particularly desirable in cases where multiple hydraulic and electrical conduits through the packer need to be protected from damage.

2. Embodiment #2

Figure 4A:
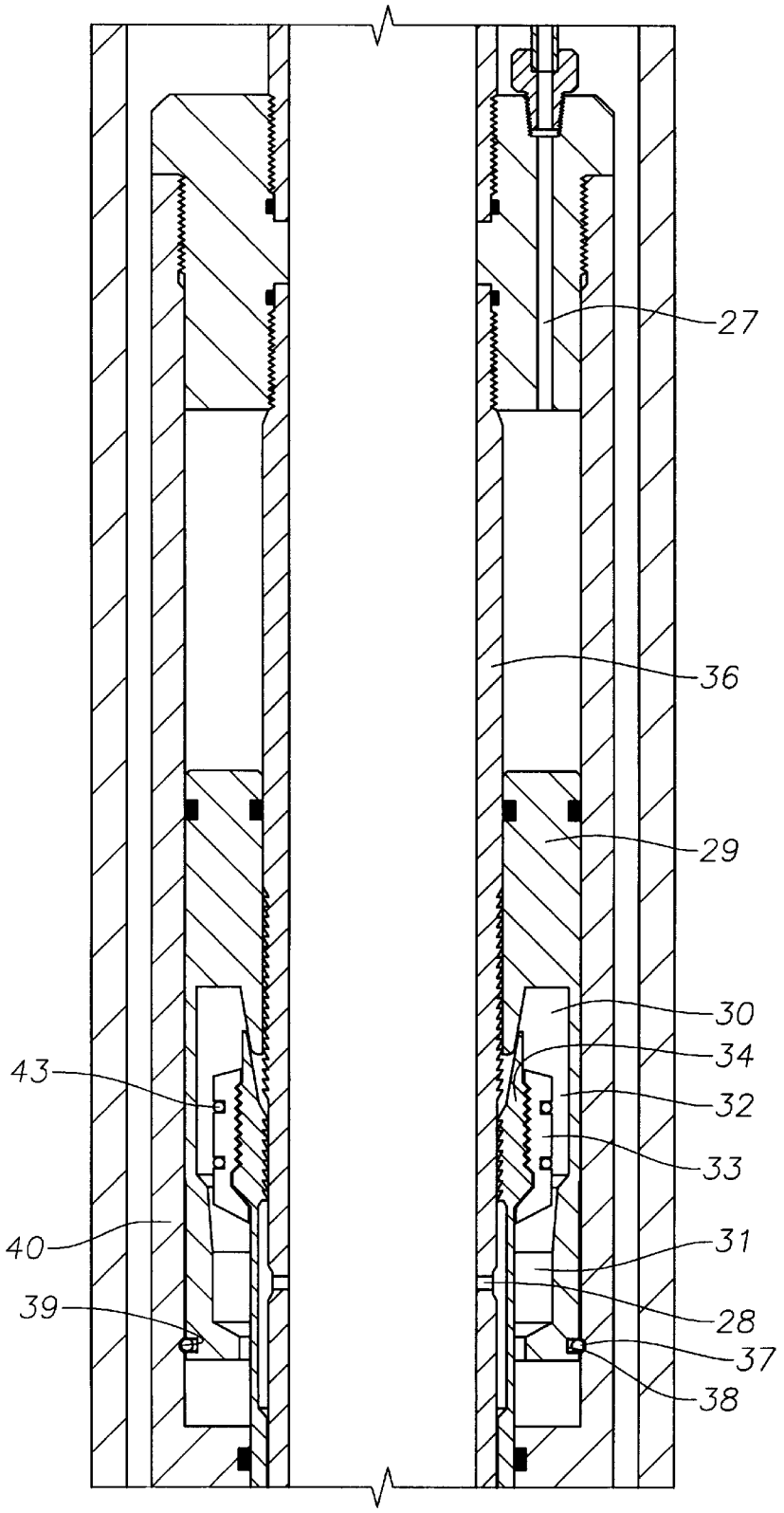
FIGS. 4A through 4B are continuations of each other and form an elevational view in cross-section showing a portion of the hydraulic packer of the second embodiment of the invention in running configuration.
Figure 4B:
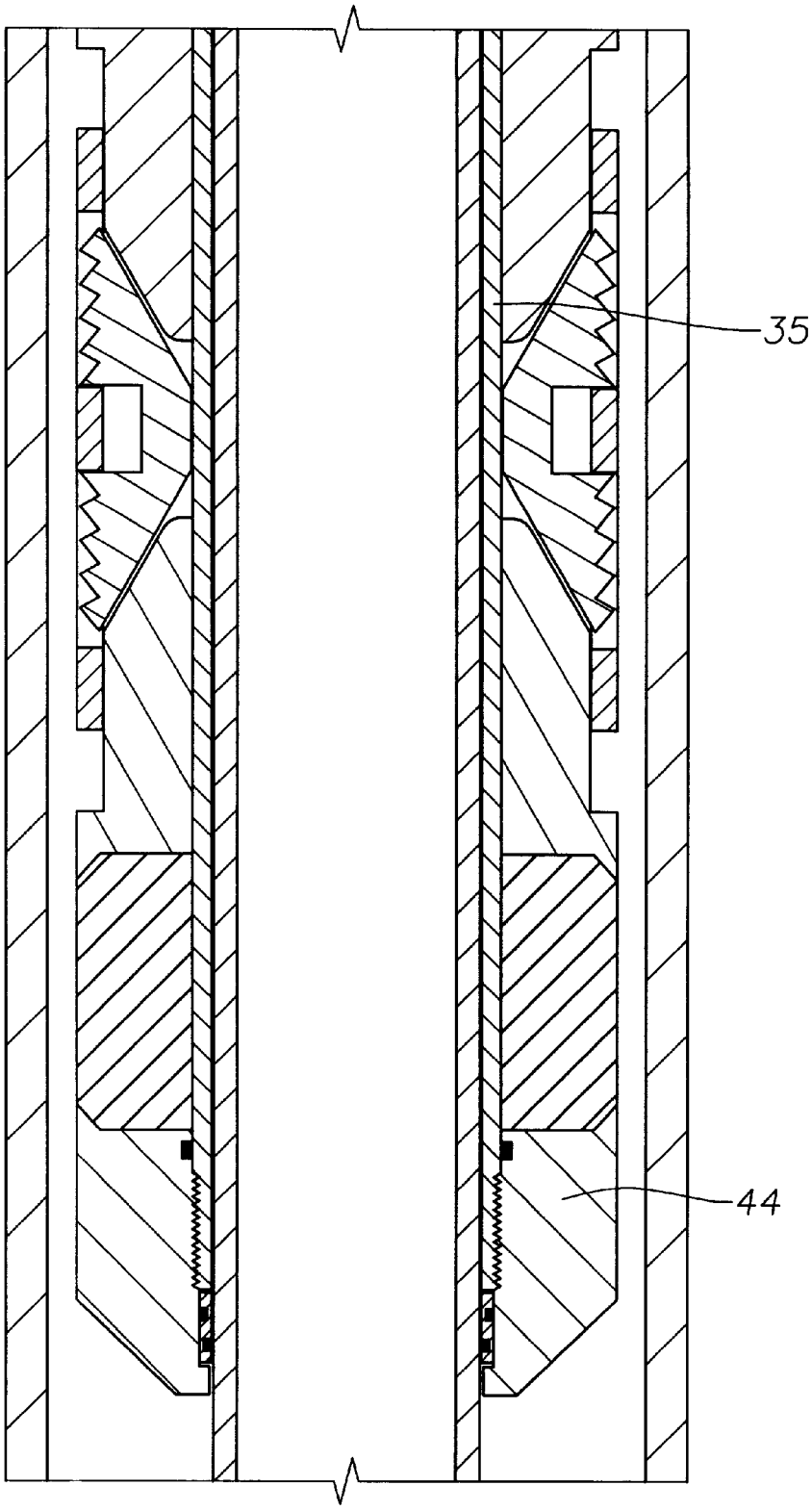
Figure 5A:
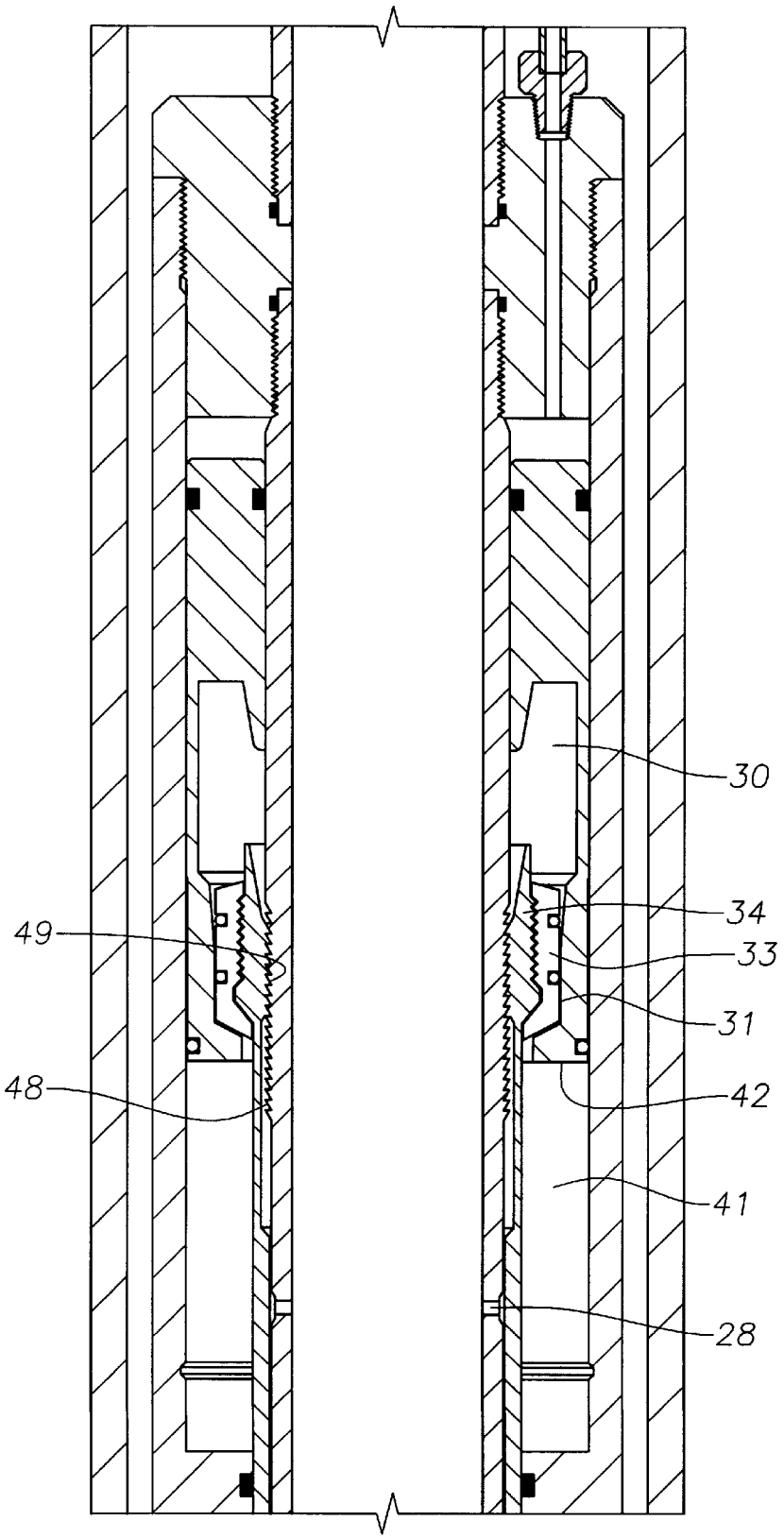
FIGS. 5A through 5B are continuations of each other and form an elevational view in cross-section showing a portion of the hydraulic packer of the second embodiment of the invention in locked configuration.
Figure 5B:
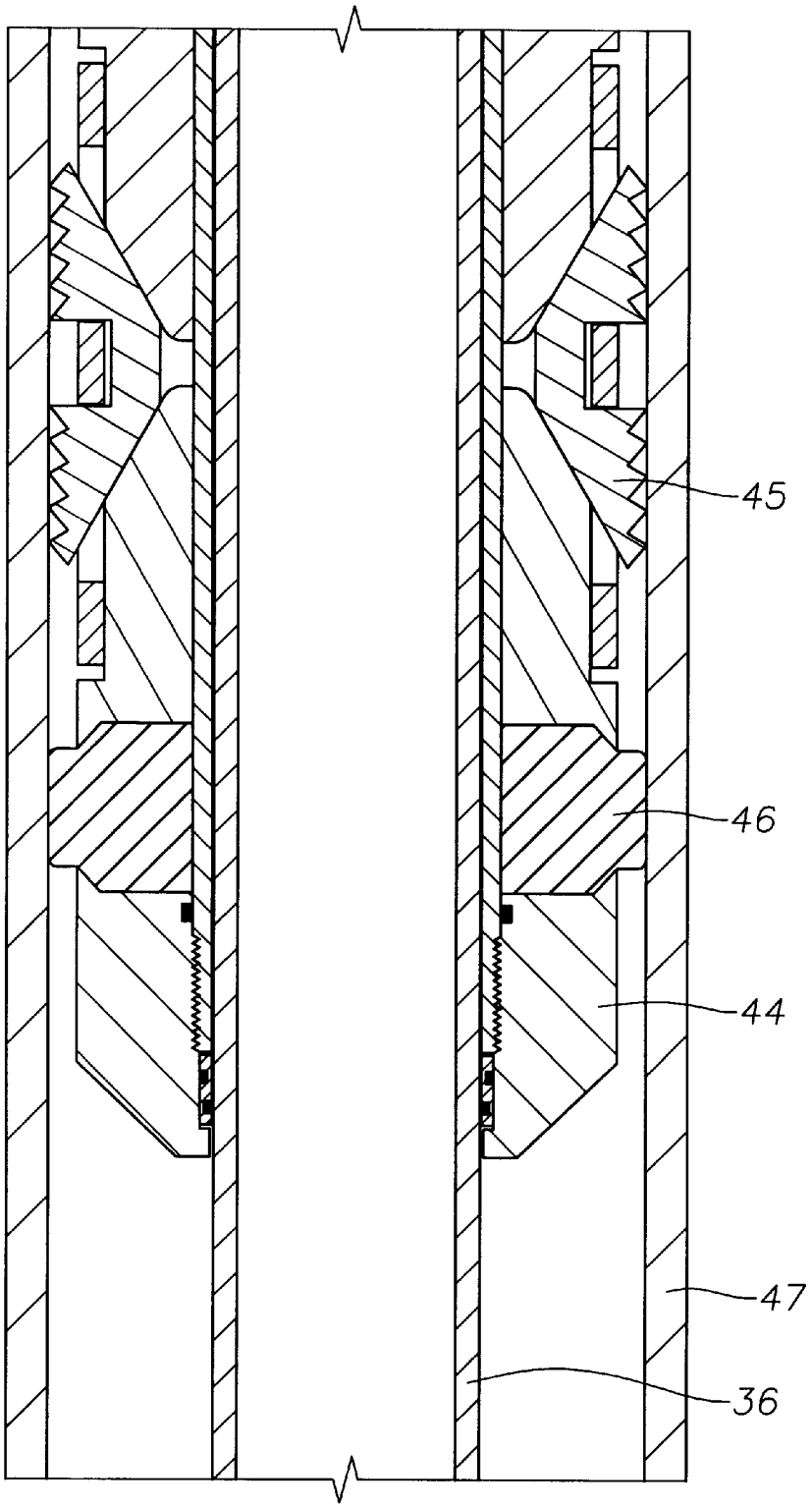

A second embodiment of the present invention is capable of being hydraulically set and locked as well as hydraulically unlocked and unset. Referring now to FIGS. 4A–4B, this embodiment uses two distinct sources of hydraulic pressure, a setting port 28 (also functions as the locking port) that sets and locks the packer and an unsetting port 27 that unlocks and unsets the packer. These ports are in communication with sources of hydraulic pressure (not shown), which may consist of hydraulic lines extending to the surface, hydraulic accumulators, or other similar devices well known to those skilled in the art. This embodiment uses at least one double acting annular piston 29 (which functions as both the setting piston and the locking piston) with an annular cavity 30 having a small section 31 and a large section 32. A segmented retaining ring 33 and the fingers 34 of a collet 35 are disposed within the annular cavity 30. The segmented retaining ring 33 is held about the fingers 34 by garter springs 43. In the preferred embodiment a segmented retaining ring 33 is separate from the fingers 34 for ease of manufacture and maintenance. However, a skilled artisan will recognize that the fingers 34 could be shaped so as to fit the small section 31 of the annular cavity 30 thus eliminating the segmented retaining ring 33. The annular cavity 30 is shaped such that when the segmented retaining ring 33 and fingers 34 are within the small section 31 they are held tightly against the mandrel 36. Conversely, when the segmented retaining ring 33 and fingers 34 are within the large section 32 the fingers 34 can be readily lifted away from the mandrel 36. While running the hydraulic packer downhole, the double acting annular piston is held in place by a lock ring 37 held between an annular groove 38 on the exterior of double acting annular piston 29 and a chamfered annular groove 39 on the interior surface of the packer wall 40.

Figure 8A:
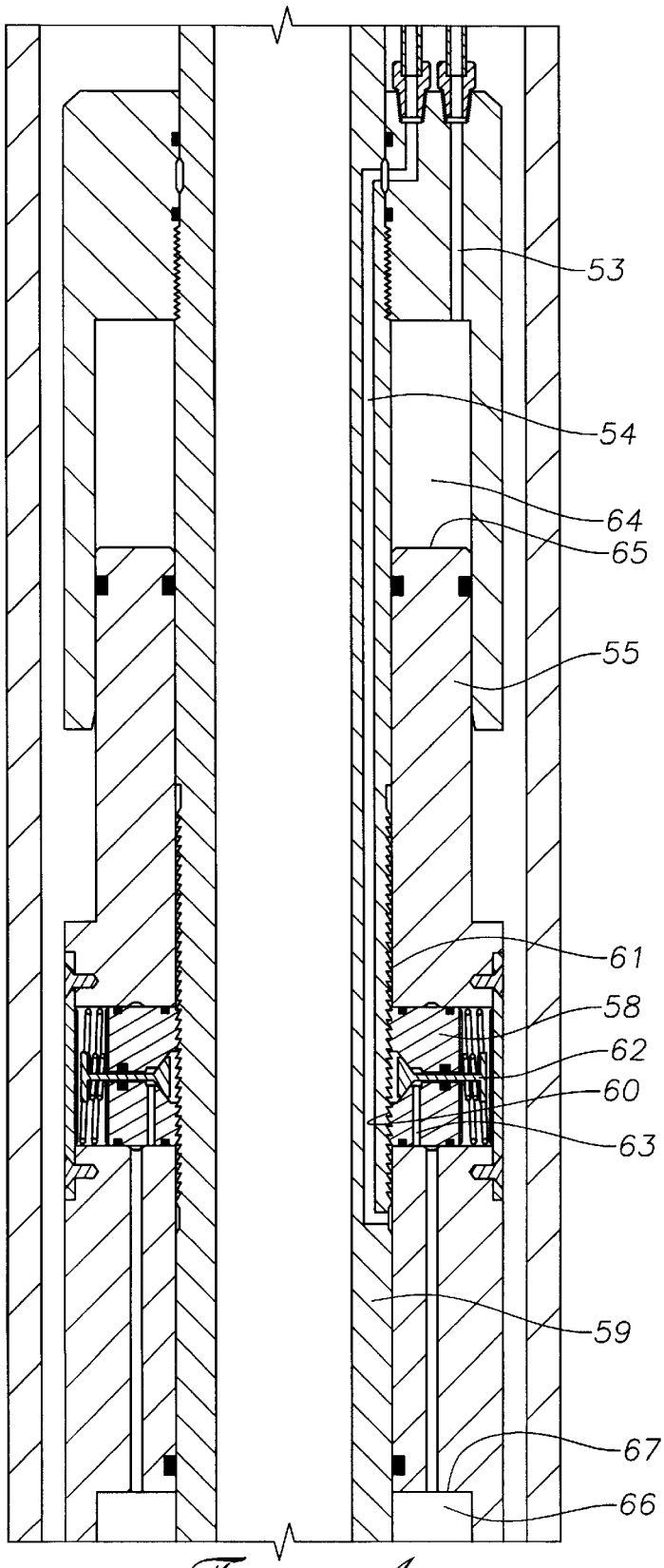
FIGS. 8A through 8B are continuations of each other and form an elevational view in cross-section showing a portion of the hydraulic packer of the third embodiment of the invention in locked configuration.
Figure 8B:
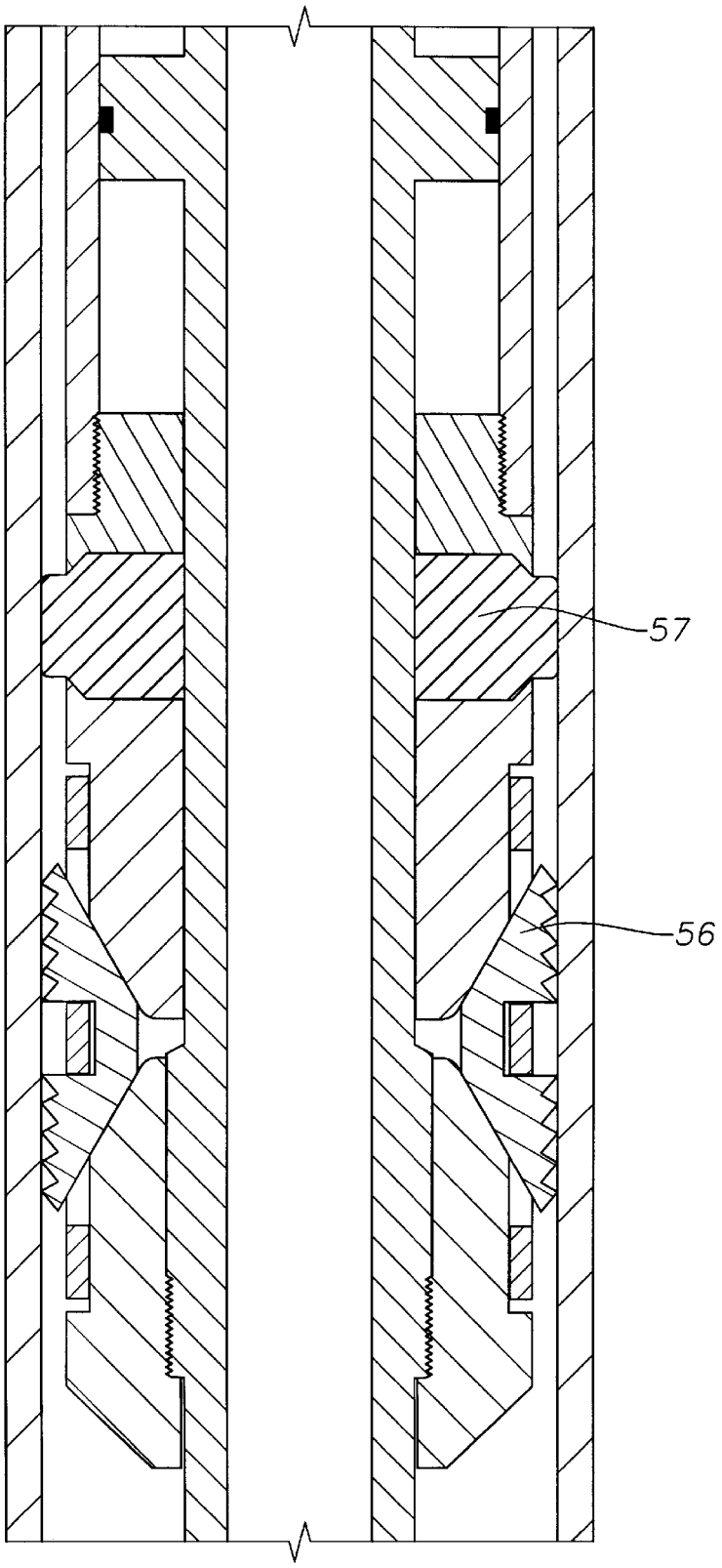

Referring now to FIGS. 8A and 8B, setting and locking of the packer is achieved by application of hydraulic pressure to the setting port 28 which pressurizes the setting chamber 41 applying force to a surface 42 of double acting annular piston 29. Upon application of sufficient force, lock ring 37 compresses allowing double acting annular piston 29 to move in a locking direction. As double acting annular piston 29 moves in a locking direction, segmented retaining ring 33 and fingers 34 slide into the small section 31 of annular cavity 30 and are pulled in the locking direction by double acting annular piston 29. Fingers 34 and collet 35 are fixedly attached to slip and sealing element actuating means 44. Thus, continued movement of the double acting annular piston 29 in the setting direction engages slips 45 and compresses sealing elements 46 thus effecting a seal between the well casing wall 47 and mandrel 36. A wide variety of slip and sealing element configurations are old and well known in the art. As will be appreciated by those skilled in the art, the present embodiment could be modified to function with a variety of other slip and sealing element configurations. It is to be understood that the embodiment described herein includes other slip and sealing element mechanisms that would be known to a skilled artisan. As the double acting annular piston 29 continues to move in a setting direction pulling segmented retaining ring 33 and fingers 34, finger ratchets 48 engage matching mandrel ratchets 49 thus locking the packer.

Figure 6:
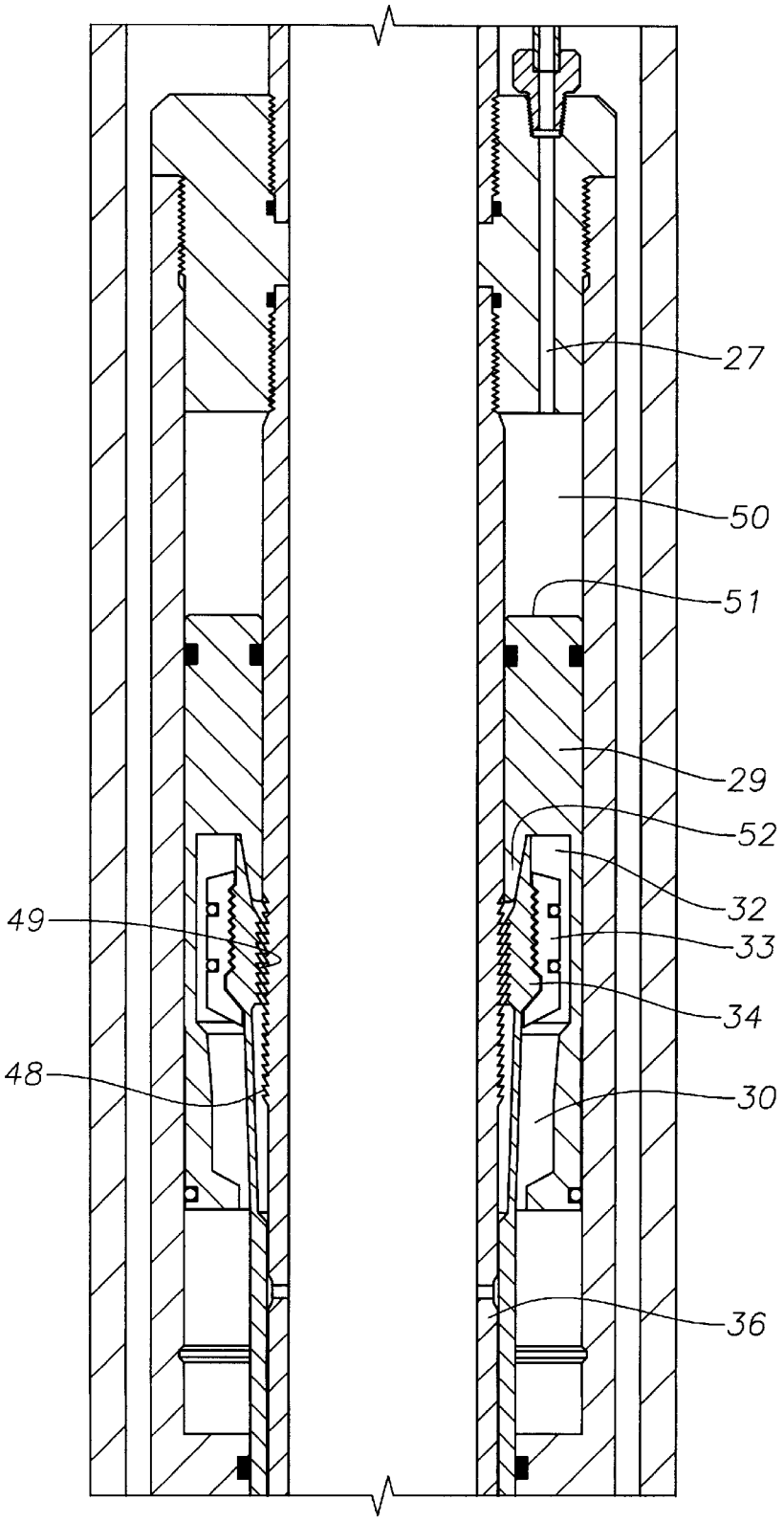
FIG. 6 is an elevational view in cross-section showing a portion of the hydraulic packer of the second embodiment of the invention being unset.

Referring now to FIG. 6, unsetting of the packer is achieved by application of hydraulic pressure to the unsetting port 27 which pressurizes the unsetting chamber 50 applying force to a surface 51 of double acting annular piston 29. This force causes double acting annular piston 29 to move in the unsetting direction and to slide in relation to the segmented retaining ring 33 and fingers 34 such that the segmented retaining ring 33 and fingers 34 are contained within the large section 32 of the annular cavity 30. As the double acting annular piston 29 continues to slide in relation to the segmented retaining ring 33 and fingers 34, a disengaging wedge 52 formed on the double acting annular piston 29 within the annular cavity 30 lifts the fingers 34 away from the mandrel 36 so that the ratchets 48 and 49 disengage. In the preferred embodiment, fingers 34 are spring loaded to circumferentially expand to aid disengagement of ratchets 48 and 49. With ratchets 48 and 49 disengaged, additional application of hydraulic pressure forces double acting annular piston 29 to continue to move in the unsetting direction returning the packer to the running configuration. At the end of the unset stroke, lock ring 37 expands into chamfered annular groove 39 to lock the packer in the running configuration.

3. Embodiment #3

Figure 7A:
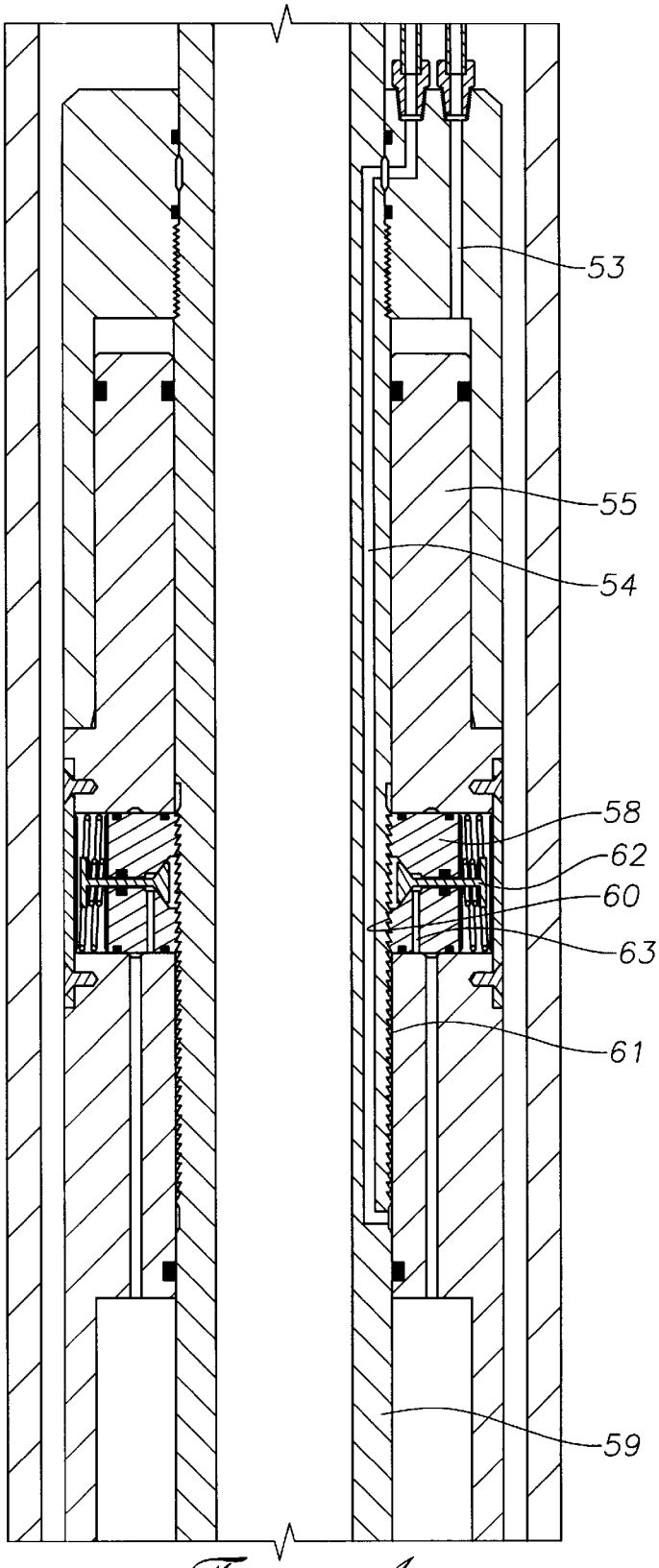
FIGS. 7A through 7B are continuations of each other and form an elevational view in cross-section showing a portion of the hydraulic packer of the third embodiment of the invention in running configuration.
Figure 7B:
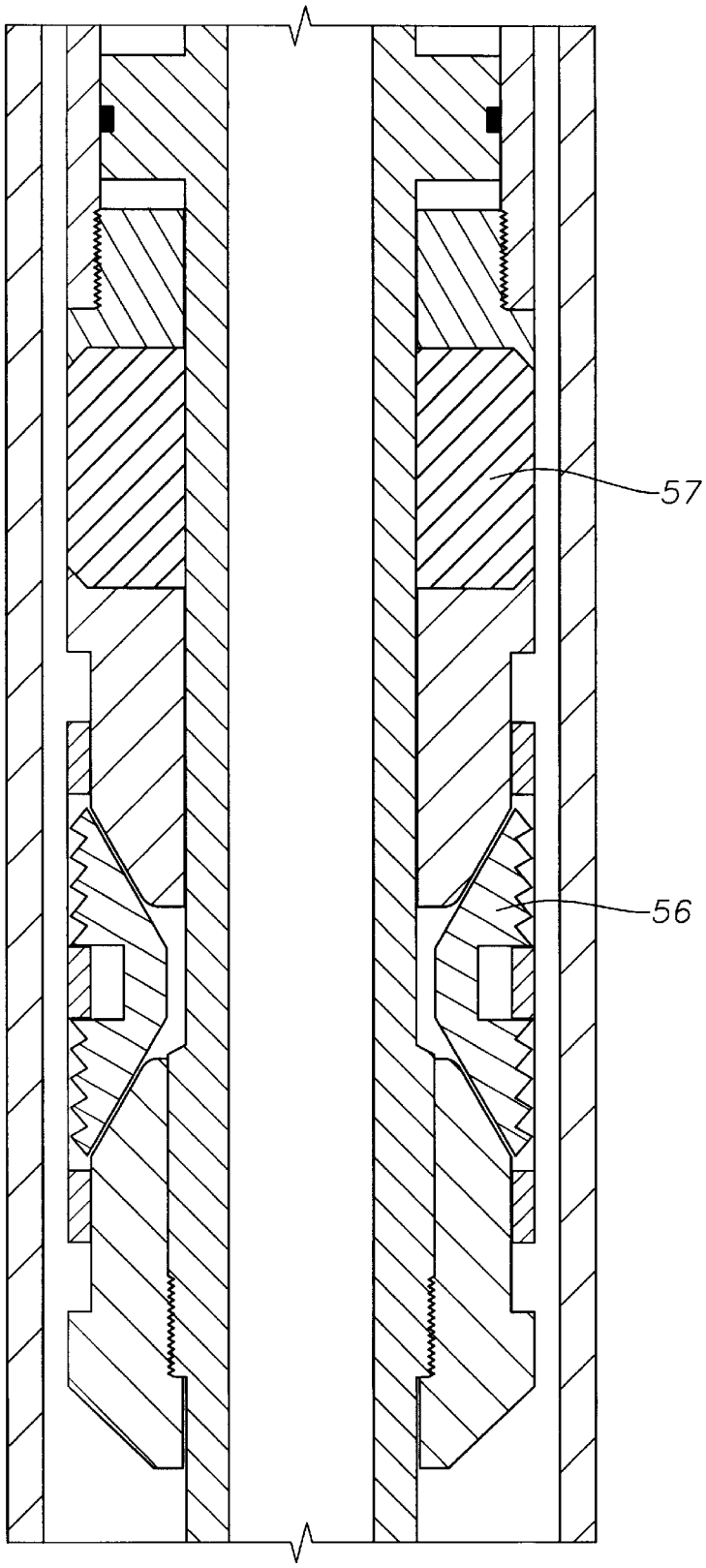

A third embodiment of the present invention is capable of being hydraulically set and locked as well as hydraulically unlocked and unset. Referring now to FIGS. 7A–7B, this embodiment uses two distinct sources of hydraulic pressure, a setting port 53 (also functions as the locking port) that sets and locks the packer and an unsetting port 54 that unlocks and unsets the packer. These ports are in communication with sources of hydraulic pressure (not shown), which may consist of hydraulic lines extending to the surface, hydraulic accumulators, or other similar devices well known to those skilled in the art. This embodiment features at least one double acting piston 55 (which functions as the setting piston) disposed to move axially and at least one locking piston 58 disposed within the double acting piston 55 and oriented to actuate in a direction perpendicular to the longitudinal axis of the mandrel 59. A ratchet surface 60 of the locking piston 58 is adjacent to the mandrel 59 and designed to engage matching ratchets 61 on the mandrel 59. The locking piston 58 is spring loaded so that it naturally presses against the mandrel 59. Within the locking piston 58 is at least one plunger valve 62 that is normally closed to a bleed port 63 within the locking piston 58.

Referring now to FIGS. 8A–8B, the packer is set and locked by applying hydraulic pressure to the setting port 53 which pressurizes setting chamber 64 thus exerting force upon a surface 65 of double acting piston 55. Upon application of sufficient hydraulic pressure, the friction between the locking piston 58 and mandrel 59 is overcome and the double acting piston 55 moves in a setting direction. As the double acting piston 55 moves in a setting direction, it actuates slips 56 and seal elements 57 in a conventional manner. A wide variety of slip and sealing element configurations are old and well known in the art. As will be appreciated by those skilled in the art, the present embodiment could be modified to function with a variety of other slip and sealing element configurations. It is to be understood that the embodiment described herein includes other slip and sealing element mechanisms that would be known to a skilled artisan. As the double acting piston 55 slides, the locking piston 58 is carried with it. The locking piston ratchets 60 engage the mandrel ratchets 61 thus locking the slips 56 and sealing elements 57 in place.

Figure 9:
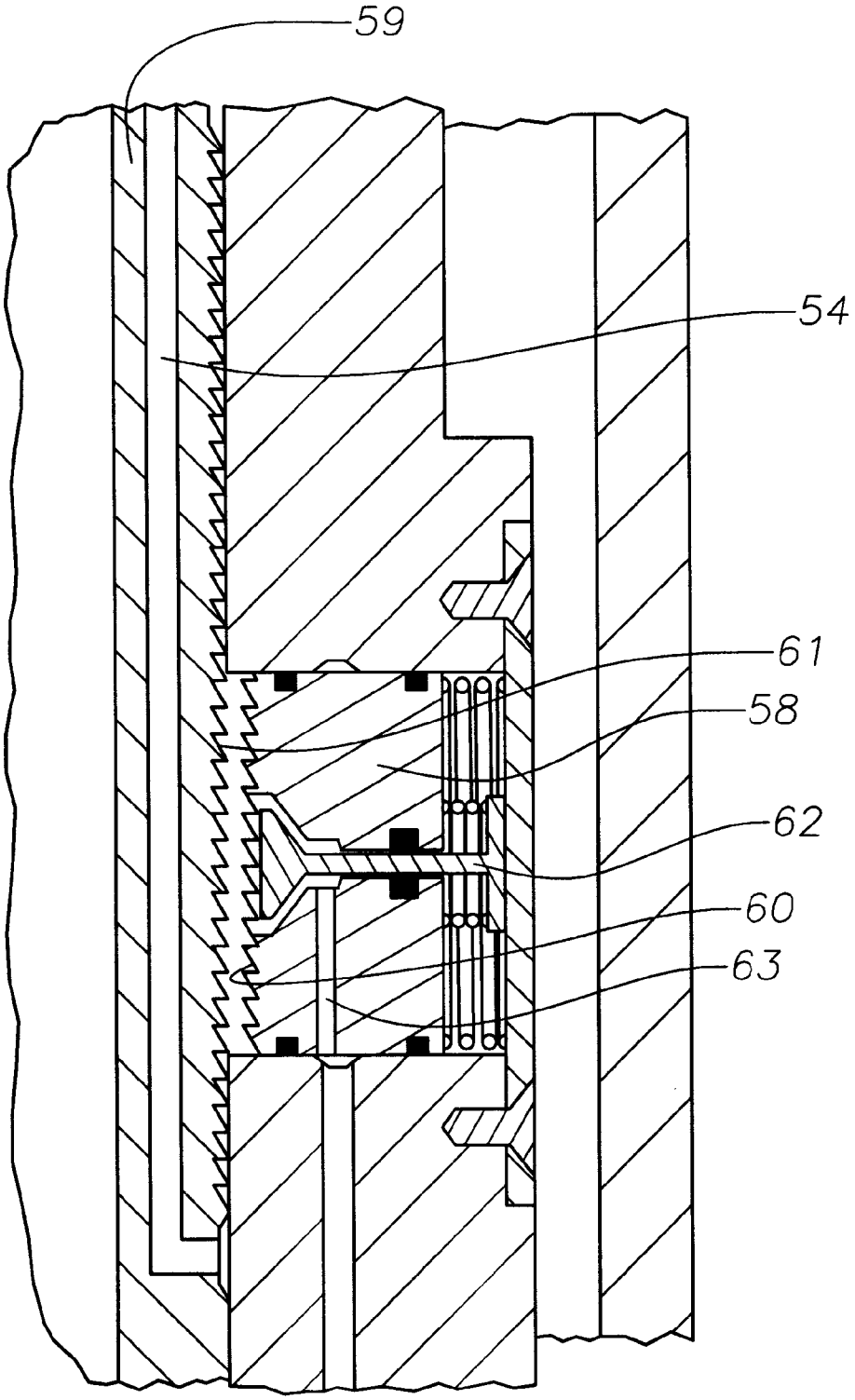
FIG. 9 is an elevational view in cross-section showing a portion of the hydraulic packer of the third embodiment of the invention being unset.

Referring now to FIGS. 8A, 8B and 9, to unlock and unset the packer, hydraulic pressure from the setting port 53 pressurizes setting chamber 64 to exert force upon surface 65 of double acting piston 55 and unload ratchets 60 and 61. Hydraulic pressure from unsetting port 54 then pressurizes the volume between ratchets 60 and 61 forcing locking piston 58 away from the surface of the mandrel 59 and disengaging ratchets 60 and 61. Plunger valve 62 is sized so that head 100 contacts retaining plate 101 thus opening plunger valve 62 when the ratchets 60 and 61 are disengaged. Upon opening, the plunger valve 62 allows pressurized hydraulic fluid from the unsetting port 54 through bleed port 63 and into unsetting chamber 66. Unsetting chamber 66 becomes pressurized and exerts force upon surface 67 of double acting piston 55. Hydraulic pressure from the setting port 53 is gradually reduced so that the force acting upon surface 67 is sufficient to overcome the force acting upon surface 65 and the double acting piston moves back to its running position unsetting the packer. Upon release of hydraulic pressure on the setting port 53 and the unsetting port 54, the packer is unset.

4. Embodiment #4

Figure 10A:
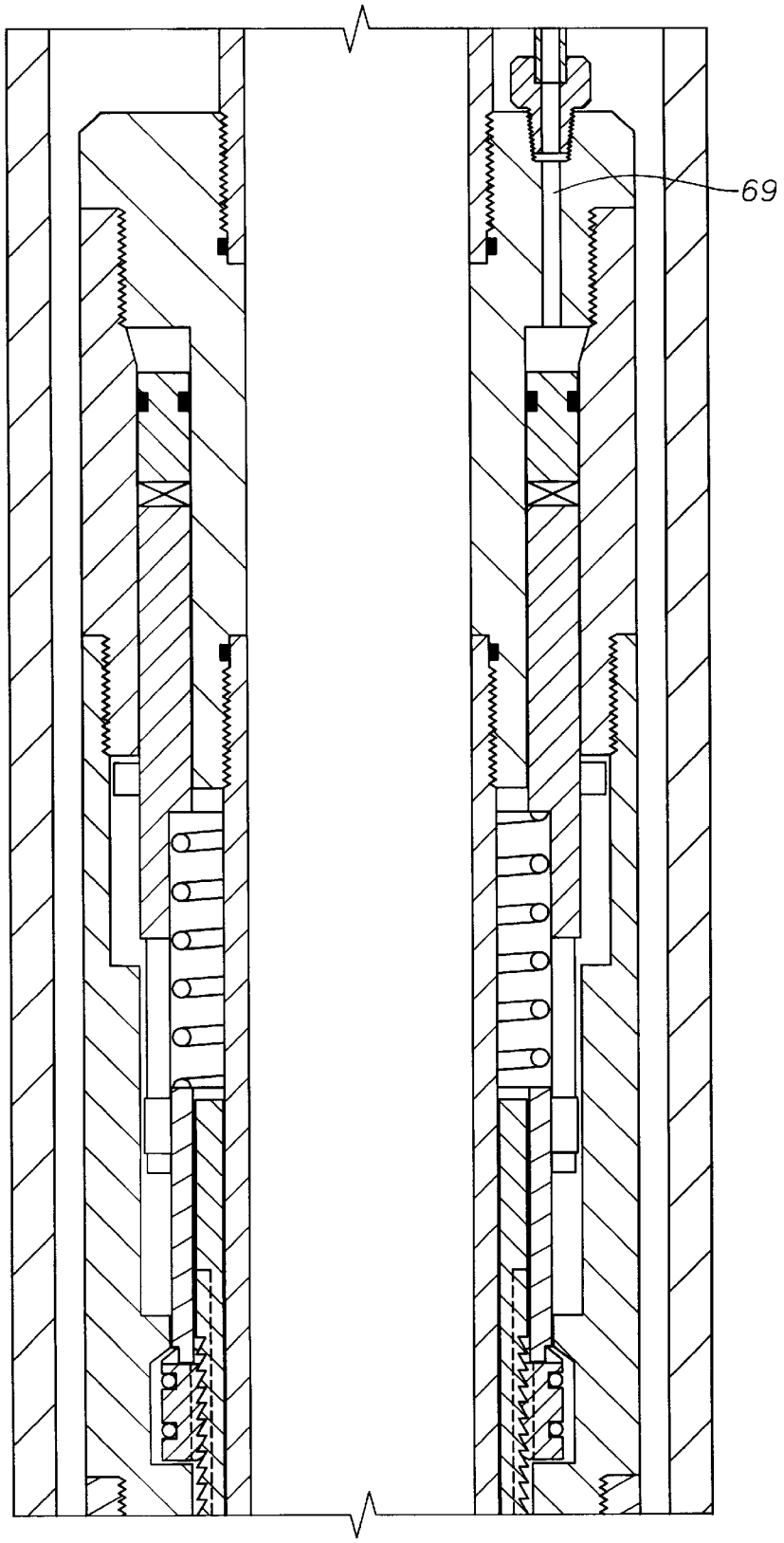
FIGS. 10A through 10C are continuations of each other and form an elevational view in cross-section showing a portion of the hydraulic packer of the fourth embodiment of the invention in running configuration.
Figure 10B:
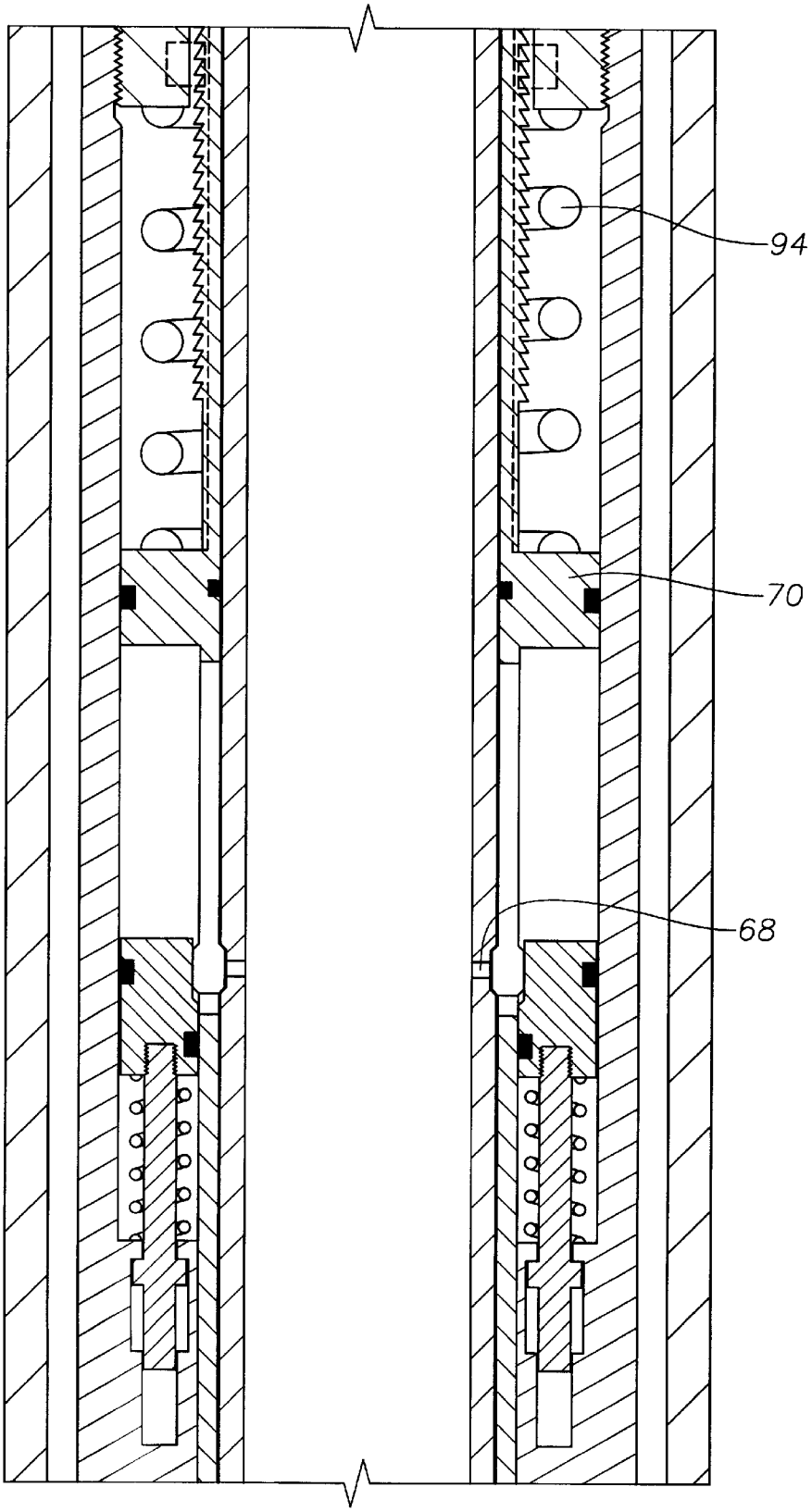
Figure 10C:
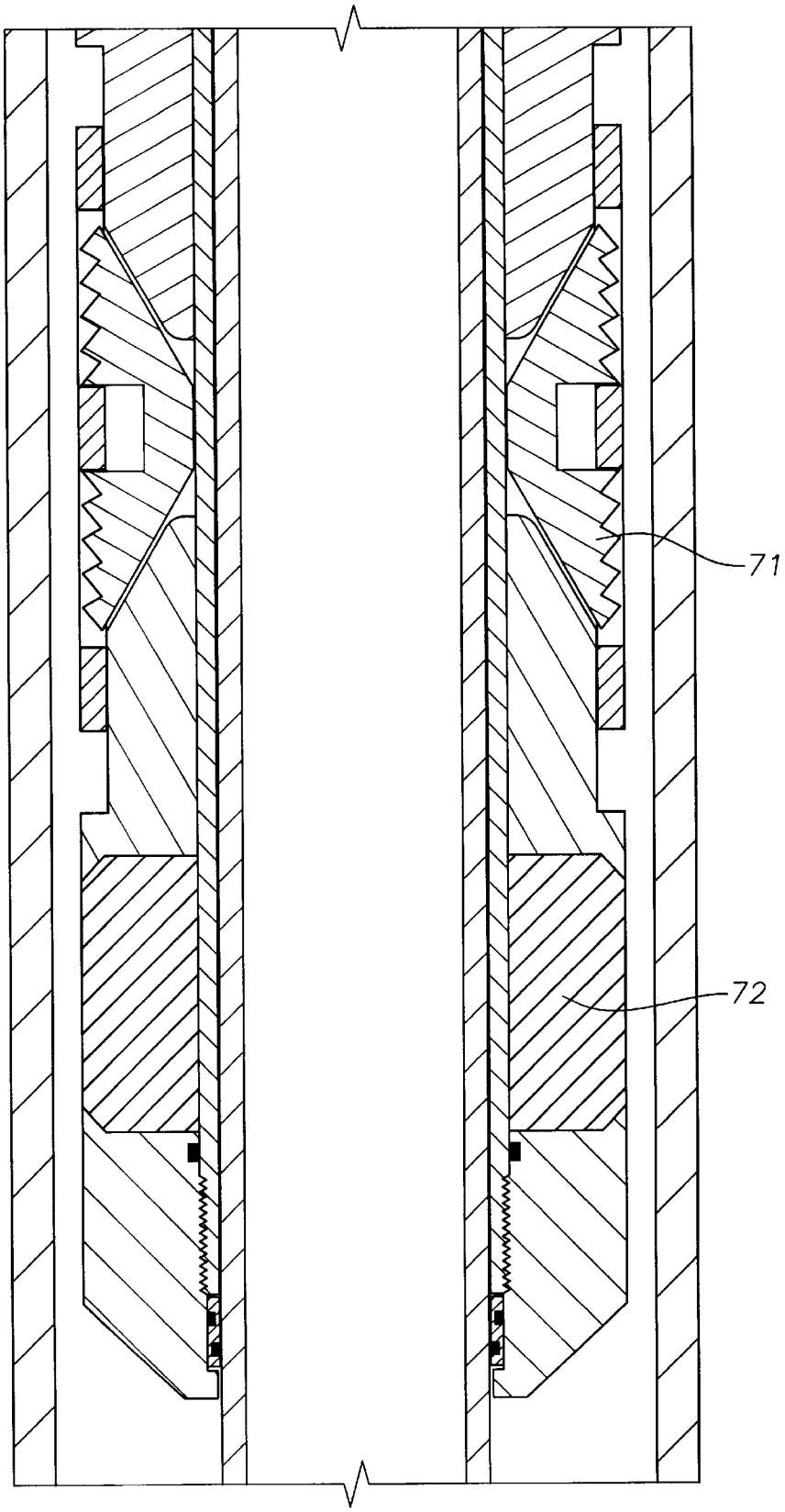
Figure 11:
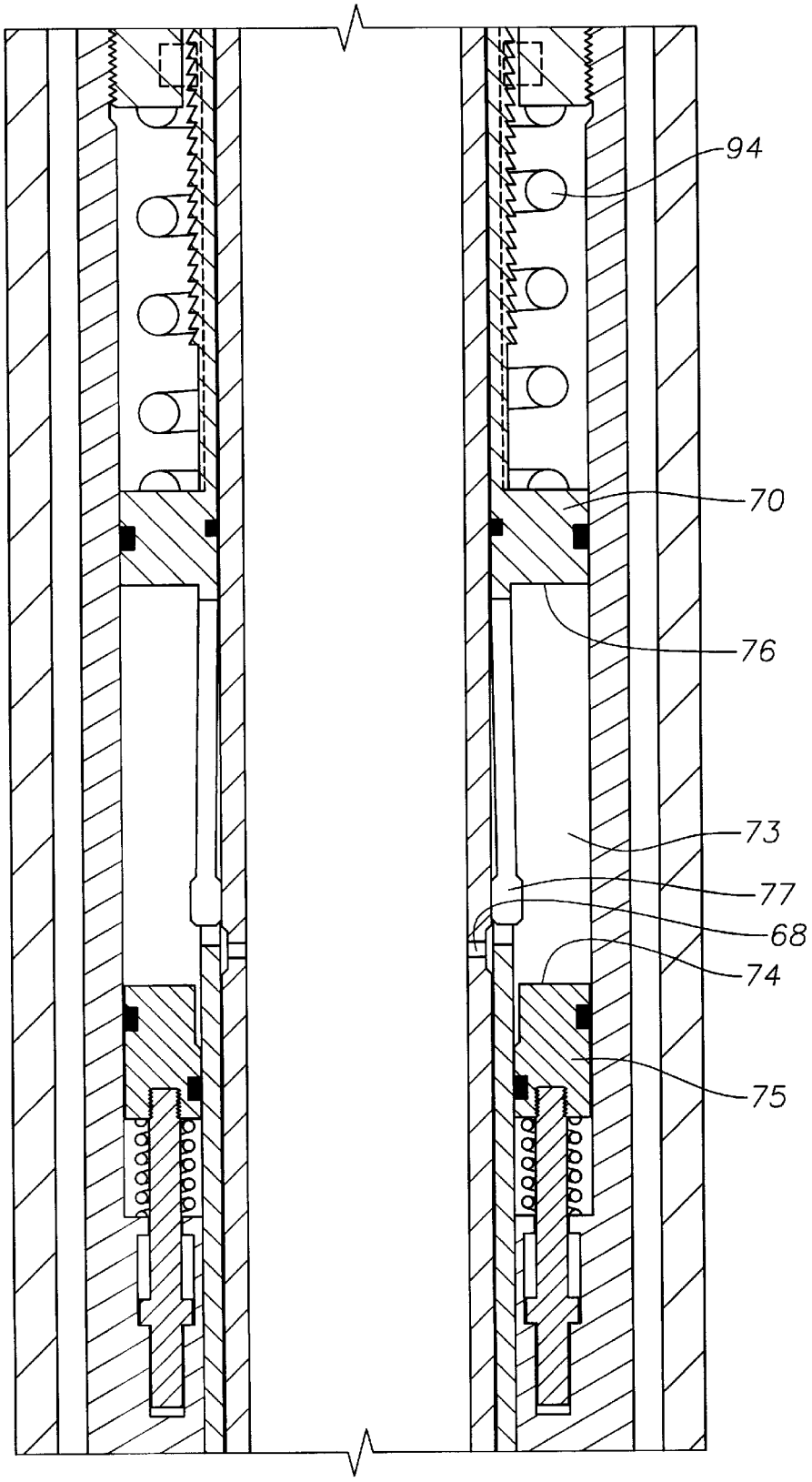
FIG. 11 is an elevational view in cross-section showing a portion of the hydraulic packer of the fourth embodiment of the invention being unlocked from running configuration.
Figure 12A:
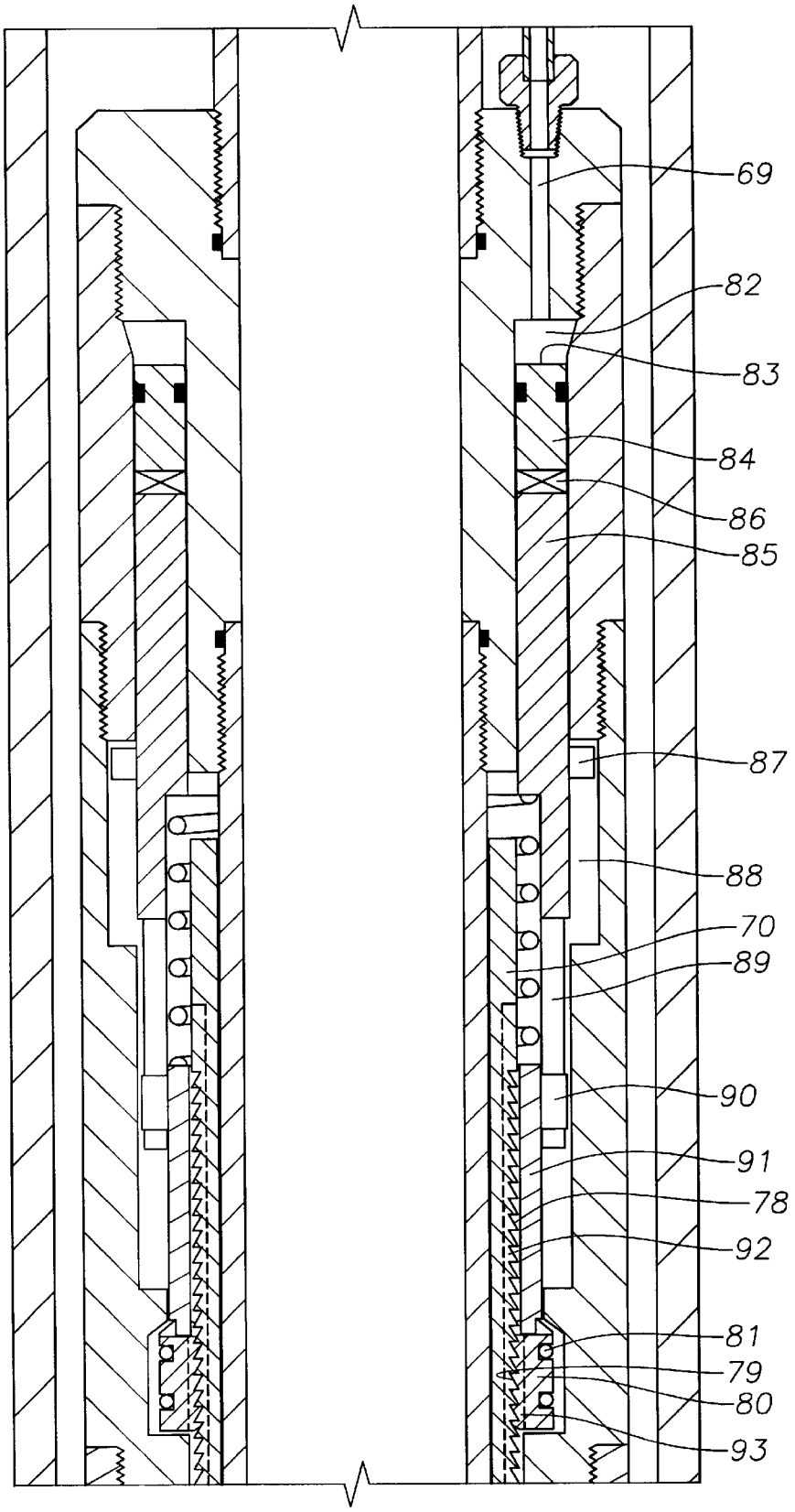
FIGS. 12A through 12C are continuations of each other and form an elevational view in cross-section showing a portion of the hydraulic packer of the fourth embodiment of the invention in locked configuration.
Figure 12B:
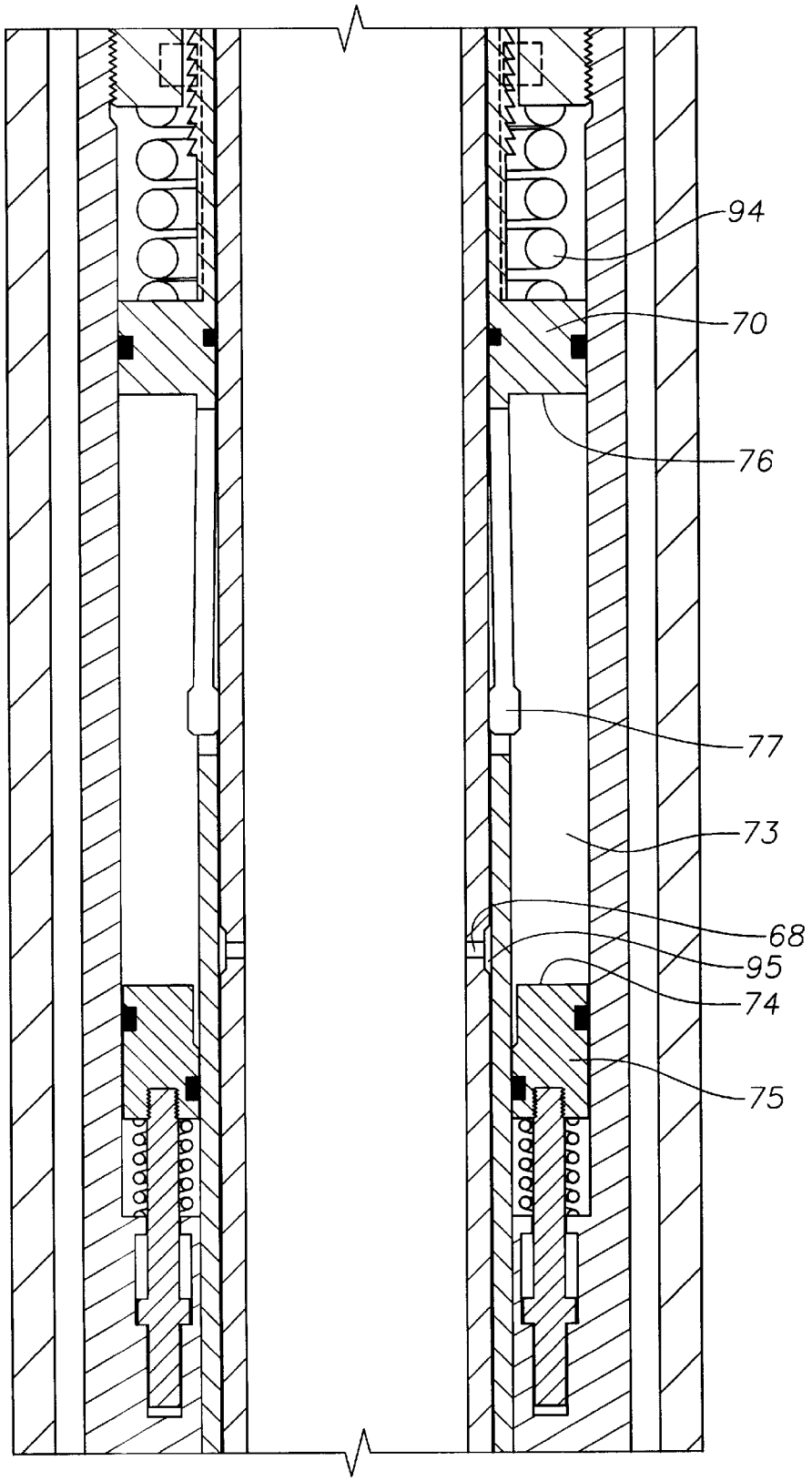
Figure 12C:
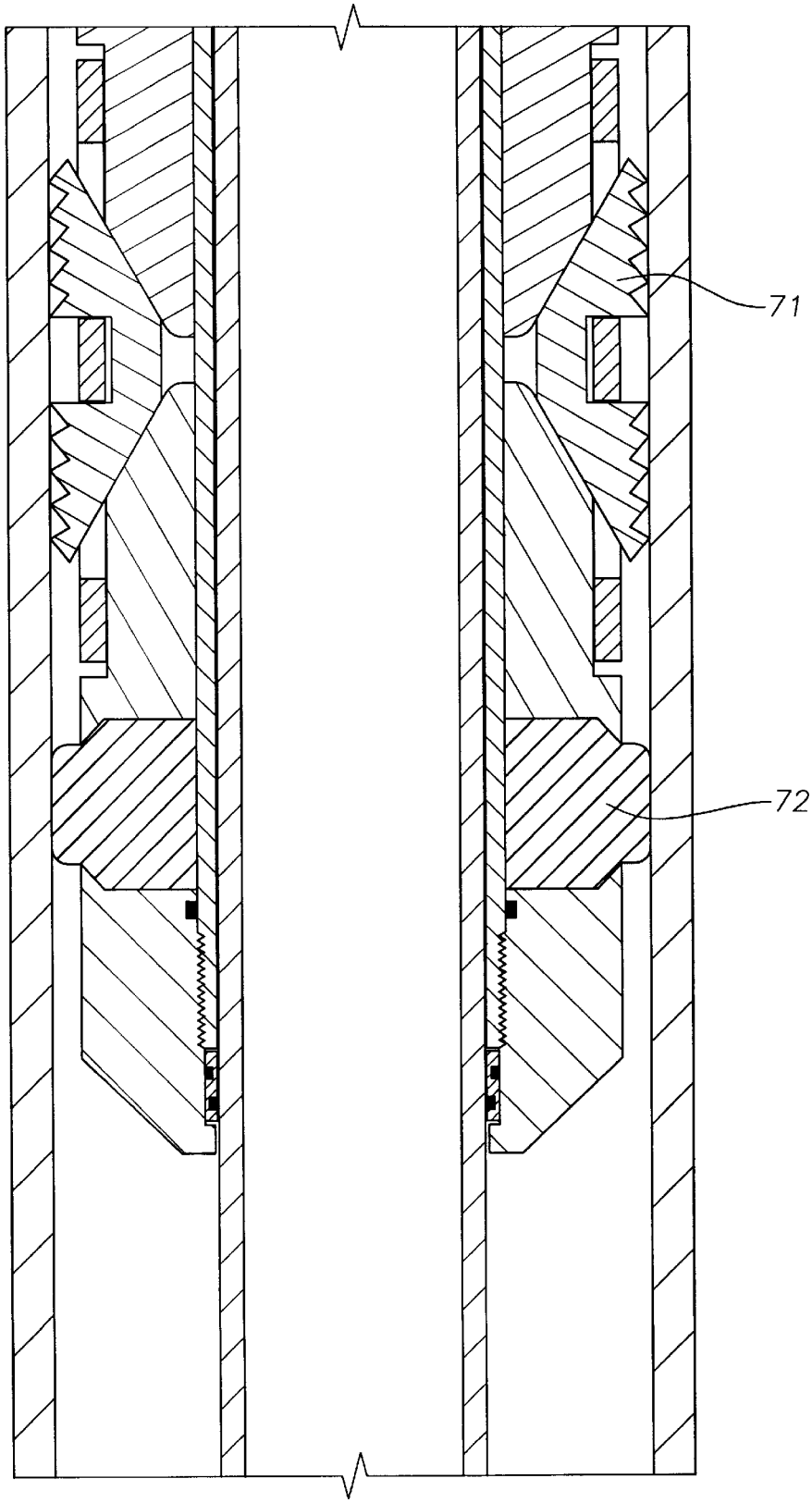
Figure 13:
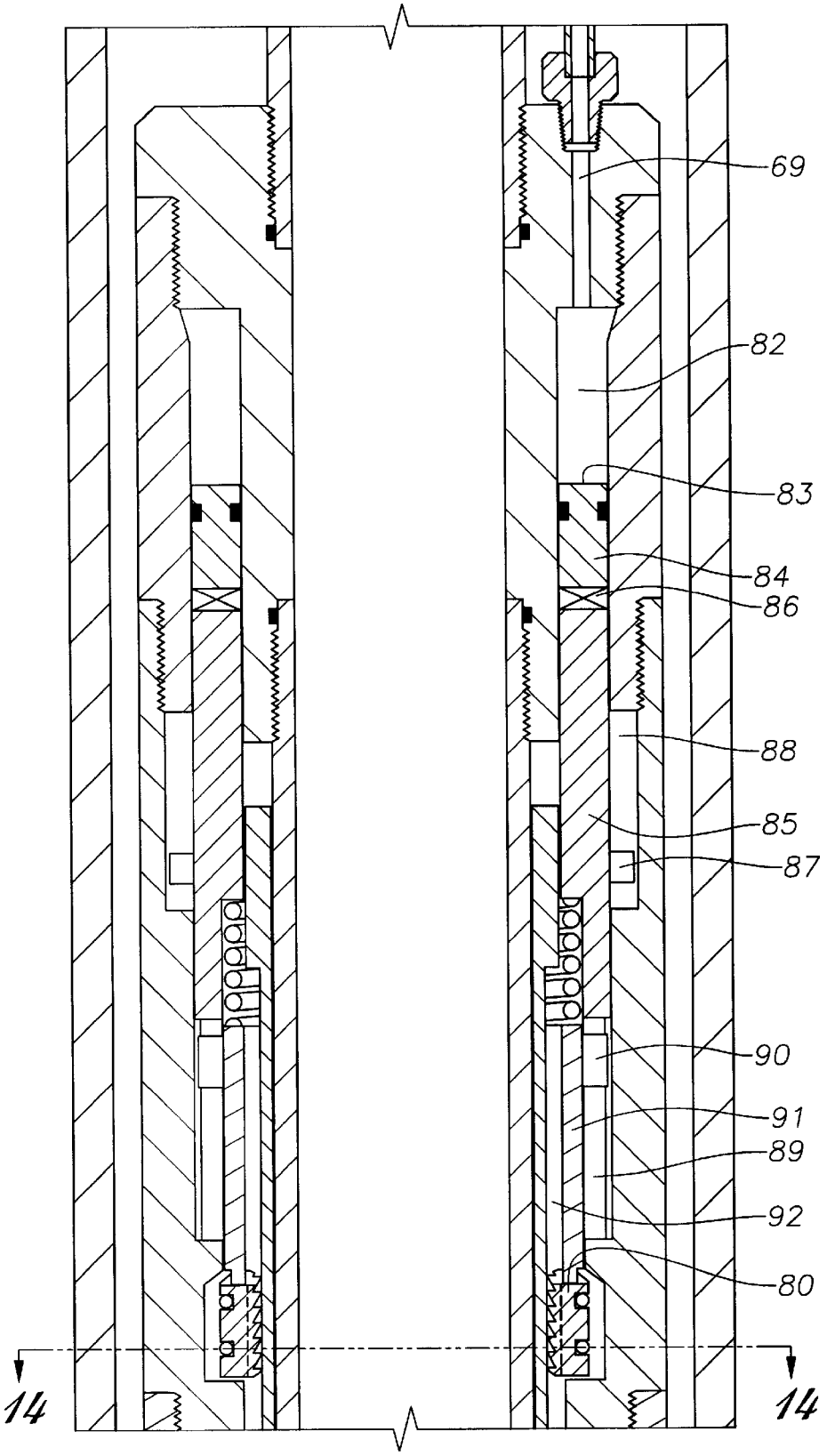
FIG. 13 is an elevational view in cross-section showing a portion of the hydraulic packer of the fourth embodiment of the invention being unlocked prior to unsetting.
Figure 14:
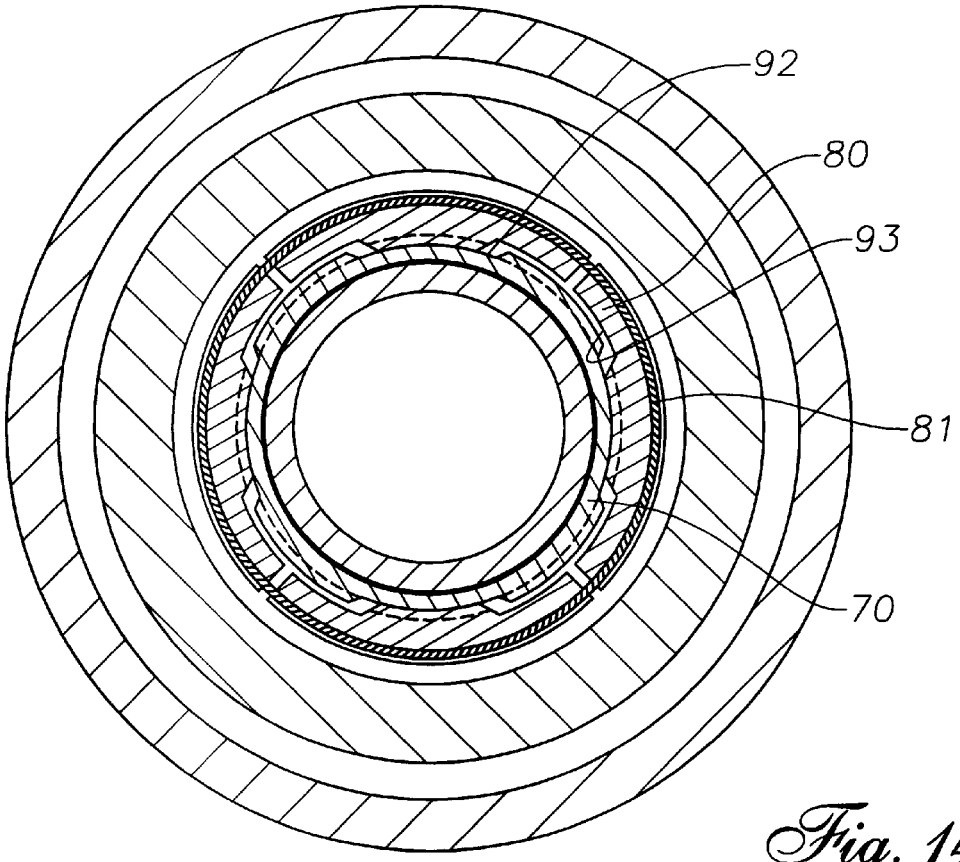
FIG. 14 is a section view through line 14—14 of FIG. 13.
Figure 15:
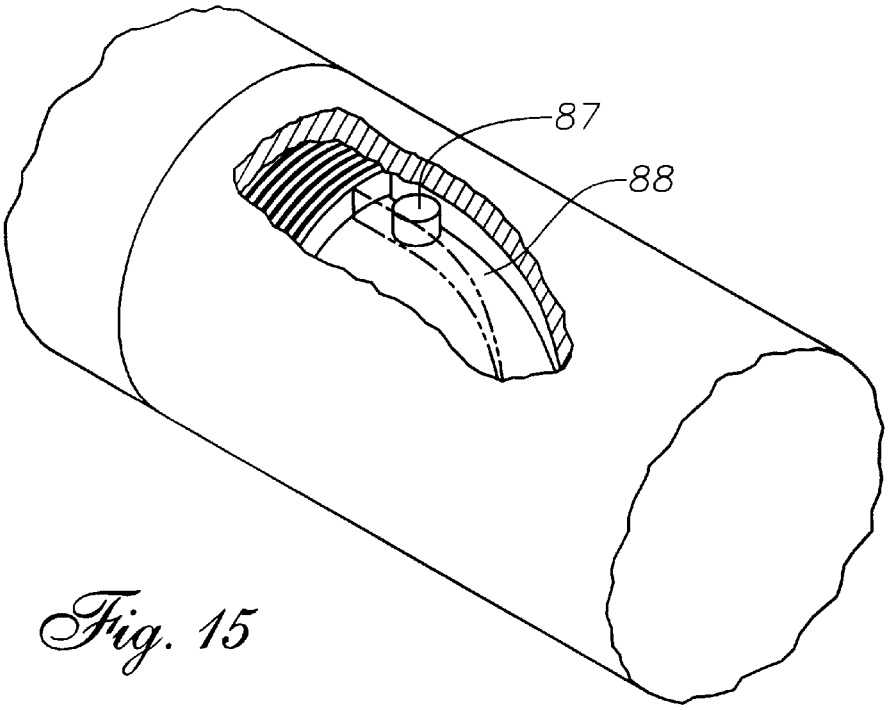
FIG. 15 is a perspective cut away view of the helical groove of the fourth embodiment of the invention.

A fourth embodiment of the present invention is capable of being hydraulically set and locked as well as unlocked and unset. Referring now to FIGS. 10A through 10C, this embodiment uses two distinct sources of hydraulic pressure, a setting port 68 (also functions as the locking port) that sets and locks the packer and an unlocking port 69 (also functions as the unsetting port) that unlocks the packer allowing it to unset. These ports are in communication with sources of hydraulic pressure (not shown), which may consist of hydraulic lines extending to the surface, hydraulic accumulators, or other similar devices well known to those skilled in the art. The hydraulic packer of this embodiment is capable of being set/locked and unlocked/unset multiple times without being removed from the well.

Referring now to FIGS. 11 and 12A to 12C, to set and lock the packer of the present embodiment, hydraulic pressure from setting port 68 pressurizes setting chamber 73 thus applying force to surface 74 of locking tackle 75 and surface 76 of setting piston 70 (which also functions as the locking piston). The force applied to surface 74 causes locking tackle 75 to slide and release collet finger 77 of setting piston 70 from groove 102. Upon release, setting piston 70 moves in a setting direction actuating slips 71 and seal elements 72 in a conventional manner. A wide variety of slip and sealing element configurations are old and well known in the art. As will be appreciated by those skilled in the art, the present embodiment could be modified to function with a variety of other slip and sealing element configurations. It is to be understood that the embodiment described herein includes other slip and sealing element mechanisms that would be known to a skilled artisan. Ratchets 78 on the setting piston 70 engage matching ratchets 79 on the interior of a rotating lock ring 80 thus setting and locking the packer. The rotating lock ring 80 is segmented and held about the setting piston 70 by garter springs 81.

Referring now to FIGS. 12A, 12B, 13, 14, and 15, to unlock and unset the packer, hydraulic pressure from setting port 68 pressurizes setting chamber 73 applying force to surface 76 to unload ratchets 78 and 79. When ratchets 78 and 79 are unloaded, hydraulic pressure from unlocking port 69 pressurizes unlocking chamber 82 applying force to surface 83 of unlocking piston 84 and causing unlocking piston 84 to translate axially in an unlocking direction. Axial translation of unlocking piston 84 is transmitted to annular housing 85 through bearing 86. Tab 87 is fixedly attached to annular housing 85 and slides within helical groove 88 thus causing annular housing 85 to rotate upon application of axial translation. Connecting rods 89 fixedly attached to annular housing 85 slidably engage lugs 90 to transmit rotation to rotating housing 91. Tabs (not shown) on rotating housing 91 transmit rotation to detents (not shown) in rotating lock ring 80.

The ratchets 78 and 79 on the setting piston 70 and the rotating lock ring 80 have axial grooves 92 and 93 that allow the ratchets 78 and 79 to disengage when the rotating lock ring 80 is rotated in relation to the setting piston 70. Likewise, the ratchets 78 and 79 reengage upon rotation of the rotating lock ring 80 to its original position. In the preferred embodiment, there are four sets of axial grooves 92 and 93. Thus, in this embodiment, the helical groove 88 is designed to turn the rotating lock ring 80 45 degrees with respect to the setting piston 70. However, one of ordinary skill in the art would readily recognize that more or fewer axial grooves 92 and 93 with a corresponding change in the degree of rotation imparted by the helical groove 88 could be used. Furthermore, one of ordinary skill in the art could readily replace the helical groove 88 with a helical W-groove to allow the rotating lock ring 80 to continue rotating in one direction as it engages and disengages the ratchets 78 and 79.

Upon disengagement of ratchets 78 and 79, hydraulic pressure from the setting port 68 is released allowing returning means 94 to return setting piston 70 to the running position thus releasing the slips 71 and sealing elements 72. In the preferred embodiment, returning means 94 is a compression spring. However, said returning means 94 could also consist of application of hydraulic force, actuation by captive gas, Belville washers, or other methods known to a skilled artisan. Setting piston 70 is locked into the running position by interaction of collet finger 77 with groove 95 and locking tackle 75. Once setting piston 70 is locked in the running position, hydraulic pressure from the unlocking port 69 is released allowing the spring return of annular housing 85 which imparts rotation to rotating lock ring 80 thus reengaging ratchets 78 and 79.

From the preceding description of the preferred embodiments, it is evident that the objects of the invention are attained. Although the invention has been described and illustrated in detail, it is to be clearly understood that the same is intended to be taken by way of illustration and example only and is not to be taken by way of limitation. The spirit and scope of the invention are to be limited only by the terms of the appended claims.

What is claimed is:

1. A downhole well apparatus comprising:

a support mandrel positionable within a well casing;

at least one setting piston movably disposed within the mandrel;

a plurality of slips supported on the support mandrel for movement relative thereto between inwardly retracted running positions and outwardly extended set positions in response to movement of the at least one setting piston;

at least one seal element disposed about the support mandrel and compressible into sealing relationship between the support mandrel and the well casing in response to movement of the at least one setting piston; and a source of setting hydraulic pressure in communication with a first surface of the setting piston and a source of unsetting hydraulic pressure in communication with a second surface of the setting piston, the setting piston setting the slips and seal element in response to setting hydraulic pressure and unsetting the slips and seal element in response to unsetting hydraulic pressure.

2. The apparatus of claim 1, further comprising a source of locking hydraulic pressure in communication with a surface of at least one locking piston such that the locking piston moves against and locks the setting piston in place in response to locking hydraulic pressure.

3. The apparatus of claim 2, wherein the locking piston includes ratchets that engage matching ratchets associated with the support mandrel to unidirectionally lock the locking piston in place as it moves.

4. The apparatus of claim 2, further including a shearable member shearably connecting the at least one locking piston to the support mandrel, the shearable member being shearable upon application of a shearing force to permit movement of the at least one locking piston relative to the support mandrel.

5. The apparatus of claim 1, further comprising a source of releasing hydraulic pressure in communication with a surface of at least one releasing piston such that the releasing piston moves and releases the slips and seal element upon application of releasing hydraulic pressure.

6. The apparatus of claim 5 further comprising at least one locking dog wherein the locking dog is held in place by at least one retainer in operative engagement with the releasing piston such that upon application of releasing hydraulic pressure, the releasing piston moves the retainer freeing the locking dog and releasing the slips and seal element.

7. The apparatus of claim 1, further including a shearable member shearably connecting the at least one setting piston to the support mandrel, the shearable member being shearable upon application of a shearing force to permit movement of the at least one setting piston relative to the support mandrel.

8. A downhole well apparatus comprising:

a support mandrel positionable within a well casing;

at least one setting piston movably disposed within the mandrel;

a plurality of slips supported on the support mandrel for movement relative thereto between inwardly retracted running positions and outwardly extended set positions in response to movement of the at least one setting piston;

at least one seal element disposed about the support mandrel and compressible into sealing relationship between the support mandrel and the well casing in response to movement of the at least one setting piston; and a source of setting hydraulic pressure in communication with a first surface of the setting piston and a source of unsetting hydraulic pressure in communication with a second surface of the setting piston, the setting piston setting and locking the slips and seal element in response to setting hydraulic pressure and unlocking and unsetting the slip and seal element in response to unsetting hydraulic pressure.

9. The apparatus of claim 8, further including a collet operatively connected to the slips and to the setting piston, and releasably engageable with the support mandrel.

10. The apparatus of claim 8, wherein the setting piston further includes a cavity with a small section and a large section, the large section including a lifting wedge, and the apparatus further includes:

at least one collet operatively engaged with the slips and seal element, the collet having fingers disposed within the cavity, the fingers being held against the support mandrel when disposed within the small section of the cavity, and the fingers being adapted to be lifted away from the support mandrel by the lifting wedge when disposed within the large section of the cavity;

ratchets on an interior surface of the fingers engageable with matching ratchets on the support mandrel and adapted to unidirectionally lock the collet in place; and wherein application of setting hydraulic pressure causes the setting piston to carry the fingers over the support mandrel ratchets thus setting and locking the slips and seal element, and application of unsetting hydraulic pressure causes the setting piston to move in an unsetting direction thus bringing the lifting wedge into contact with the fingers to lift the fingers away from the support mandrel and unlock and unset the slips and seal element.

11. The apparatus of claim 10, further including a retaining ring held about the collet fingers by at least one garter spring.

12. The apparatus of claim 8, further including at least one locking piston releasably engageable with the support mandrel, disposed within the setting piston and oriented to actuate in a direction perpendicular to a longitudinal axis of the support mandrel.

13. The apparatus of claim 12, the at least one locking piston further including ratchets on a surface adjacent to the support mandrel engageable with matching ratchets on the support mandrel to unidirectionally lock the setting piston in place, wherein application of setting hydraulic pressure causes the setting piston and locking piston to slide axially engaging the locking piston ratchets and support mandrel ratchets thus setting and locking the slips and seal element.

14. The apparatus of claim 12, wherein the at least one locking piston further includes at least one support plate and locking piston spring to bias the locking piston against the support mandrel.

15. The apparatus of claim 12, wherein the at least one locking piston further includes ratchets that are releasably engaged to ratchets on the mandrel, the at least one locking piston further includes a bleed port for directing hydraulic fluid to a hydraulic passage that leads to a second surface of the setting piston and at least one normally-closed plunger valve disposed within the locking piston for sealing the bleed port, and the plunger valve sized to open upon lifting of the locking piston when the locking piston ratchets are clear of the mandrel ratchets, wherein application of unsetting hydraulic pressure first acts against the locking piston lifting the locking piston ratchets away from the mandrel ratchets to a point where the plunger valve opens allowing unsetting hydraulic pressure through the bleed port and hydraulic passage to act against the second surface of the setting piston thus unlocking and unsetting the slips and seal element.

16. The apparatus of claim 8, further including a lock ring disposed about the at least one setting piston and releasably engageable with an annular groove in the support mandrel.

17. A downhole well apparatus comprising:

a support mandrel positionable within a well casing;

at least one setting piston movably disposed within and releasably engageable with the support mandrel;

a plurality of slips supported on the support mandrel for movement relative thereto between inwardly retracted running positions and outwardly extended set positions in response to movement of the at least one setting piston;

at least one seal element disposed about the support mandrel and compressible into sealing relationship between the support mandrel and the well casing in response to movement of the at least one setting piston;

a source of setting hydraulic pressure in communication with a surface of the setting piston, the setting piston disposed for movement into engagement with the support mandrel in response to setting hydraulic pressure and returning to its original position upon disengagement from the support mandrel in response to removal of setting hydraulic pressure; and at least one unlocking piston having a surface in communication with a source of unlocking hydraulic pressure, the unlocking piston disposed for movement in response to unlocking hydraulic pressure and returning to an original position upon removal of unlocking hydraulic pressure.

18. The apparatus of claim 17, further including:

ratchets on the setting piston and matching ratchets on the interior of a rotating lock ring for unidirectionally locking the setting piston in place;

axial grooves in the setting piston ratchets and in the rotating lock ring ratchets that allow the setting piston ratchets and rotating lock ring ratchets to engage and disengage as the rotating lock ring is rotated in relation to the setting piston; and a tab disposed for helical movement within a helical groove, one of the tab and groove being connected to the at least one unlocking piston and the other of the tab and groove being connected to the support mandrel, whereby longitudinal movement of the unlocking piston causes rotational movement of the rotating lock ring to engage and disengage the setting piston ratchets and rotating lock ring ratchets;

wherein the setting piston and rotating lock ring ratchets engage and lock the setting piston as the setting piston moves in response to setting hydraulic pressure thus setting and locking the slips and seal element, and application of unlocking hydraulic pressure causes the setting piston ratchets and rotating lock ring ratchets to disengage and unlock the apparatus thus allowing said setting piston to return to its original position and unset the slips and seal element.

19. The apparatus of claim 17, further including:

ratchets on the setting piston and matching ratchets on the interior of a rotating lock ring for unidirectionally locking the setting piston in place;

axial grooves in the setting piston ratchets and in the rotating lock ring ratchets that allow the setting piston ratchets and rotating lock ring ratchets to engage and disengage as the rotating lock ring is rotated in relation to the setting piston;

an annular housing connected to the unlocking piston and to the rotating lock ring, and movably disposed within the support mandrel in response to movement of the unlocking piston; and a tab disposed for helical movement within a helical groove, one of the tab and groove being connected to the annular housing and the other of the tab and groove being connected to the support mandrel, whereby movement of annular housing causes rotational movement of the rotating lock ring to engage and disengage the setting piston and rotating lock ring ratchets.

20. The apparatus of claim 19, further including a bearing disposed between the unlocking piston and the annular housing.

21. The apparatus of claim 17, wherein the setting piston further includes at least one collet finger releaseably engageable with a groove in the support mandrel.

22. The apparatus of claim 21, further including a locking tackle movably disposed within the support mandrel in response to hydraulic setting pressure and adapted to releasably maintain the collet finger in engagement with the groove in the support mandrel.

23. The apparatus of claim 17, further including a spring in operative engagement with the setting piston and adapted to bias the setting piston to its original position.

24. The apparatus of claim 17, further including means for biasing the setting piston to its original position.

25. The apparatus of claim 17, further including a spring in operative engagement with the unsetting piston and adapted to bias the unsetting piston to its original position.

26. The apparatus of claim 17, further including means for biasing the unsetting piston to its original position.

27. A downhole well apparatus comprising:

a support mandrel positionable within a well casing;

at least one setting piston movably disposed within the mandrel;

a plurality of slips supported on the support mandrel for movement relative thereto between inwardly retracted running positions and outwardly extended set positions in response to movement of the at least one setting piston;

at least one seal element disposed about the support mandrel and compressible into sealing relationship between the support mandrel and the well casing in response to movement of the at least one setting piston;

a source of setting hydraulic pressure and a source of unsetting hydraulic pressure, the setting piston setting the slips and seal element in response to setting hydraulic pressure and unsetting the slips and seal element in response to unsetting hydraulic pressure; and the setting piston adapted to set and unset the slips and seal element a plurality of times.

28. A method for operating a downhole well apparatus, comprising:

providing the apparatus with a support mandrel positionable within a well casing, at least one setting piston movably disposed within the mandrel, a plurality of slips supported on the mandrel for movement relative thereto between inwardly retracted running positions and outwardly extended set positions in response to movement of the at least one setting piston, and at least one seal element disposed about the mandrel and compressible into sealing relationship between the mandrel and the casing in response to movement of the at least one setting piston;

setting the slips and seal element in response to the application of setting hydraulic pressure to the setting piston;

unsetting the slips and seal element in response to the application of unsetting hydraulic pressure to the setting piston; and resetting and unsetting the slips and seal element a plurality of times.

29. A method for operating a downhole well apparatus, comprising:

providing the apparatus with a support mandrel positionable within a well casing, at least one setting piston movably disposed within the mandrel, a plurality of slips supported on the mandrel for movement relative thereto between inwardly retracted running positions and outwardly extended set positions in response to movement of the at least one setting piston, and at least one seal element disposed about the mandrel and compressible into sealing relationship between the mandrel and the casing in response to movement of the at least one setting piston;

setting the slips and seal element in response to the application of setting hydraulic pressure to a first surface of the setting piston; and unsetting the slips and seal element in response to the application of unsetting hydraulic pressure to a second surface of the setting piston.

30. The method of claim 29 further comprising locking the slips and seal element in response to the application of setting hydraulic pressure to the first surface of the setting piston and unlocking the slips and seal element in response to application of unsetting hydraulic pressure to the second surface of the setting piston.

31. A method for operating a downhole well apparatus, comprising:

providing the apparatus with a support mandrel positionable within a well casing, at least one setting piston movably disposed within and releasably engageable with the mandrel, a plurality of slips supported on the mandrel for movement relative thereto between inwardly retracted running positions and outwardly extended set positions in response to movement of the at least one setting piston, at least one seal element disposed about the mandrel and compressible into sealing relationship between the mandrel and the casing in response to movement of the at least one setting piston, and at least one unlocking piston movably disposed within the mandrel;

setting and locking the slips and seal element by engaging the setting piston with the mandrel in response to the application of setting hydraulic pressure to a surface of the setting piston;

returning the setting piston to its original position upon disengagement from the mandrel in response to removal of setting hydraulic pressure;

unsetting and unlocking the slips and seal element by moving the unlocking piston in response to the application of unlocking hydraulic pressure to a surface of the unlocking piston; and returning the unlocking piston to its original position upon removal of the unlocking hydraulic pressure.

* * * * *